US012753461B2

(12) United States Patent
Rijkenberg et al.

(10) Patent No.: US 12,753,461 B2
(45) Date of Patent: Oct. 6, 2026

(54) HOT ROLLED HIGH STRENGTH STEEL STRIP HAVING HIGH HOLE EXPANSION RATIO

(71) Applicant: TATA STEEL IJMUIDEN B.V., Velsen-Noord (NL)

(72) Inventors: Rolf Arjan Rijkenberg, Santpoort-Noord (NL); Shangping Chen, Beverwijk (NL); Maxim Peter Aarnts, Castricum (NL)

(73) Assignee: TATA STEEL IJMUIDEN B.V., Velsen-Noord (NL)

( * ) Notice: Subject to any disclaimer, the term of this patent is extended or adjusted under 35 U.S.C. 154(b) by 839 days.

(21) Appl. No.: 17/786,402

(22) PCT Filed: Dec. 18, 2020

(86) PCT No.: PCT/EP2020/086977
§ 371 (c)(1),
(2) Date: Jun. 16, 2022

(87) PCT Pub. No.: WO2021/123130
PCT Pub. Date: Jun. 24, 2021

(65) Prior Publication Data

US 2023/0045924 A1 Feb. 16, 2023

(30) Foreign Application Priority Data

Dec. 20, 2019 (EP) ..... 19218799

(51) Int. Cl.
*C21D 9/52* (2006.01)
*C21D 6/00* (2006.01)
(Continued)

(52) U.S. Cl.
CPC ..... *C21D 9/52* (2013.01); *C21D 6/002* (2013.01); *C21D 6/005* (2013.01); *C21D 6/008* (2013.01);
(Continued)

(58) Field of Classification Search
CPC ..... C21D 2211/001; C21D 2211/002; C21D 2211/003; C21D 2211/008; C21D 6/002;
(Continued)

(56) References Cited

U.S. PATENT DOCUMENTS 8,052,808 B2 11/2011 Kimijima
2013/0061989 A1* 3/2013 Nakamura ..... C22C 38/005 148/333
2020/0071789 A1* 3/2020 Chen ..... C21D 1/20

FOREIGN PATENT DOCUMENTS

CN 109023036 A 12/2018
EP 2559783 A1 2/2013
(Continued)

OTHER PUBLICATIONS

Written Opinion and International Search Report for corresponding PCT Application No. PCT/EP2020/086977 mailed Mar. 31, 2021.
(Continued)

*Primary Examiner* — Lois L Zheng
(74) *Attorney, Agent, or Firm* — Vorys, Sater, Seymour and Pease LLP; Maryellen Feehery Hank

(57) ABSTRACT

A high strength steel with a careful selection of the normal alloying elements C, Mn, Si and Al, together with micro-element addition. This a steel with a high strength and high hole expansion ratio can be produced. The invention also relates to the method to manufacture this high strength steel.

21 Claims, 1 Drawing Sheet

(51) Int. Cl.

| | |
|---|---|
| ***C21D 8/02*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |

(52) U.S. Cl.
CPC ..... *C21D 8/02* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C21D 2211/001* (2013.01); *C21D 2211/002* (2013.01); *C21D 2211/008* (2013.01)

(58) Field of Classification Search
CPC ..... C21D 6/005; C21D 6/008; C21D 8/0205; C21D 8/0226; C21D 8/0263; C21D 8/0405; C21D 8/0426; C21D 8/0463; C21D 9/52; C22C 38/001; C22C 38/002; C22C 38/02; C22C 38/04; C22C 38/06; C22C 38/12; C22C 38/14; C22C 38/22; C22C 38/24; C22C 38/26; C22C 38/28; C22C 38/32; C22C 38/38
See application file for complete search history.

(56) References Cited

FOREIGN PATENT DOCUMENTS

| | | | | |
|---|---|---|---|---|
| EP | 2617850 | A1 | 7/2013 | |
| EP | 2617852 | A1 | 7/2013 | |
| EP | 2924140 | A1 | 9/2015 | |
| EP | 2987883 | A1 | 2/2016 | |
| EP | 2987887 | A1 | 2/2016 | |
| EP | 3296415 | A1 | 3/2018 | |
| JP | 5200984 | B2 | 6/2013 | |
| WO | 2018134186 | A1 | 7/2018 | |
| WO | 2018150955 | A1 | 8/2018 | |
| WO | WO-2018193032 | A1 * | 10/2018 | ..... C22C 38/48 |

OTHER PUBLICATIONS

International Preliminary Report on Patentability for corresponding PCT Application No. PCT/EP2020/086977 mailed Jun. 6, 2022.

AUTORENKILLEKTIV: "Spurenelemente in Stahl—Moeglichkeiten zur Beerin flussung im Smelzbetrieb", Sprurenelemente in Staehlen, Verlag Stahleisen, Dusseldorf, DE, Jan. 1, 1985 (Jan. 1, 1985), pp. 19-22, XP002433212.

* cited by examiner

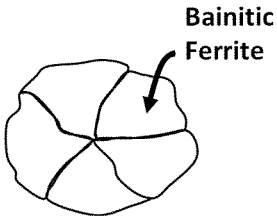
| FERRITIC BAINITE (FB) |
| --- |
| Building blocks |
| BF Type 1 (KAM 0-1) |
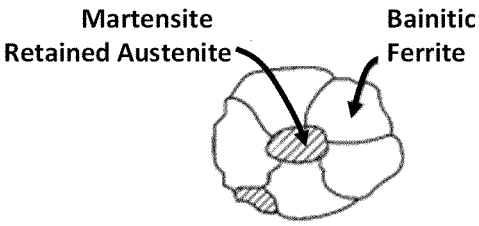
| GRANULAR BAINITE (GB) | |
| --- | --- |
| Building blocks | |
| BF Type 1 (KAM 0-1) | M/RA |
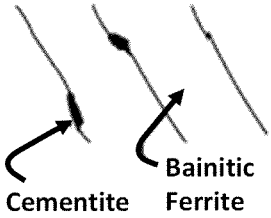
| UPPER BAINITE (UB) | |
| --- | --- |
| Building blocks | |
| BF Type 2 (KAM 1-5) | $Fe_3C$ |
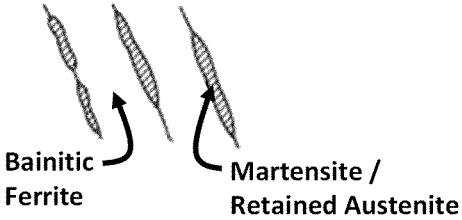
| CEMENTITE-FREE BAINITE (CFB) | |
| --- | --- |
| Building blocks | |
| BF Type 2 (KAM 1-5) | M/RA |

HOT ROLLED HIGH STRENGTH STEEL STRIP HAVING HIGH HOLE EXPANSION RATIO

The invention relates to a hot rolled steel strip having a high strength and a high hole expansion ratio.

High strength steels are used in the automotive industry to improve in-service performance and/or to reduce the weight and fuel consumption of cars. However, a high strength alone for instance to improve in-service performance is not sufficient for instance for relatively complex-shaped automotive components, like those found in automotive chassis and suspension. The value of using high strength steels for automotive chassis components for instance, may be to increase the collapse strength to uphold component integrity in case of an accident. However, the higher the strength of steel, the more difficult it is to form the steel into an automotive component without splitting of the steel at the sheared or punched edges of a blank from which a component is formed. Reason for this is that the increased strength in most cases is obtained from the presence of low-temperature transformation products in the microstructure via transformation hardening. However, this leads to increased differences in hardness in the final microstructure, which in turn is at the expense of stretch flangeability. Thus, the application of high strength multi-phase steels such as DP and TRIP steels, but to some extent also multi-phase CP steel is limited by the formability of these steel types for specific automotive applications like highly intricate complex-shaped chassis and suspension components.

Furthermore, in order to save component weight, the common approach is to use high strength steel and to reduce the thickness of the steel sheet used to save weight. However, this can lead to a loss in stiffness, which for some applications in automotive body-in-white, chassis and suspension, and/or seating and interior is crucial. For instance, for automotive chassis components stiffness is a key performance parameter as lack of stiffness is at the expense of car handling and passenger safety. The intrinsic loss in stiffness by reducing the thickness of the steel used to manufacture automotive chassis components, can be regained by optimisation of the component geometry by—for instance—creating deeper flanges and/or flanges with an increased degree of stretching and/or bending. To allow automotive engineers to strive to increase component stiffness via geometry optimisation, the high strength steel used needs to have excellent formability in terms of good stretchability (or tensile elongation) and excellent stretch flangeability (or hole expansion capacity).

In recent years the steel suppliers have developed high strength steel types that both have a reasonable ultimate tensile strength Rm and a reasonable total elongation A50 or A80. These mechanical properties provide information about the strength and stretchability of the steel type.

However, for certain applications of the high strength steel in the automotive industry it is also a requirement that the steel has a good stretch flangeability. The stretch flangeability is an indication of the formability at the flange of a sheet, but also at the edge of an aperture in the sheet. The stretch flangeability is usually measured by the expansion of a circular punched hole in a sheet, and is indicated by the hole expansion ratio λ. The hole expansion ratio λ is often determined in accordance with the Japan Iron and Steel Federation Standard JFS T 1001. This standard will be adhered to in the below.

It is an object of the invention to provide a hot rolled high strength steel having a high hole expansion ratio.

It is also an object of the invention to provide a high strength steel with a good elongation and a high hole expansion ratio.

It is a further object of the invention to provide a high strength steel having a tensile strength of at least 760 MPa and a hole expansion ratio of at least 50%.

It is another object of the invention to provide a high strength steel having a tensile strength of at least 960 MPa and a hole expansion ration of at least 40%.

It is furthermore an object of the invention to provide such a high strength steel, also having a total elongation A50 or A80 of at least 9±1%

According to the invention a hot rolled high strength steel strip is provided, consisting of:

0.02-0.13 wt. % C;
1.20-3.50 wt. % Mn;
0.10-1.00 wt. % Si;
0.01-0.10 wt. % Al_tot;
0.04-0.25 wt. % Ti;
0-0.010 wt. % N;
0-0.10 wt. % P;
0-0.01 wt. % S;

optionally 0-0.005 wt. % B, preferably 0.0005-0.005 wt. % B;

optionally one or more of:

0-1.5 wt. % Cu;
0-1.0 wt. % Cr;
0-1.0 wt. % Mo;
0-0.50 wt. % Ni;
0-0.30 wt. % V;
0-0.10 wt. % Nb;

wherein Ti+Nb≤0.25 wt. %,
wherein Cr+Mo≤1.0 wt. %,
the remainder being iron and inevitable impurities,
the steel having a microstructure consisting of (in volume %):

at least 85% bainite,
at most 10% martensite plus retained austenite,
more than 0% and at most 5% cementite,
inevitable amounts of inclusions, the sum adding up to 100 volume %, wherein the steel strip has the following mechanical properties:
a tensile strength of at least 760 and at most 960 MPa,
a total elongation (A50) of at least 10%,
a hole expansion ratio (λ) value of at least 50%, or wherein the steel strip has the following mechanical properties:
a tensile strength of at least 960 and at most 1380 MPa,
a total elongation (A50) of at least 9%,
a hole expansion ratio (λ) value of at least 40%.

Using this composition with this microstructure for a hot rolled steel makes it possible to provide the steel with a high strength, that is a strength above 760 MPa and a high hole expansion ratio λ. As always is the case, the higher the strength is, the lower the formability will be. This also hold for the hole expansion ratio. When the hot rolled steel according to the invention has a medium high tensile strength, for instance between 760 and 960 MPa, the hole expansion ratio can be at least 50%. For a higher strength steel, for instance having a tensile strength between 960 and 1380 MPa, the hole expansion ratio can be lower, for instance 40% or more.

Using the composition according to the invention provides a microstructure that almost entirely consists of bainite. Preferably no martensite and retained austenite is present. However, due to the hot rolling and coiling conditions, some cementite will be present, but less than 5%. Further, small amounts of carbides, precipitates and inevitable inclusions may be present in the steel.

The high strength and high formability, especially the high hole expansion ratio are derived from the careful selection of the normal alloying elements C, Mn, Si and Al, together with micro-element addition. The elements used in the composition according to the invention are discussed herein below.

Carbon is present in an amount between 0.02 and 0.13 weight %. C is a bainite forming element and as such an essential element to achieve a final microstructure that provides sufficient strength and formability in terms of tensile elongation and hole-expansion capacity. To achieve sufficient strength, a suitable minimum C content is 0.02 weight %, or in a preferable embodiment at least 0.03 weight %. A low C content, in a preferable embodiment at most 0.12 weight %, preferably 0.09 weight %, or more preferably at most 0.06 weight %, is beneficial to suppress the effect of cooling rate dependence on the homogeneity of the final microstructure and to promote high hole-expansion capacity. Furthermore, C is an essential element to achieve precipitation strengthening in combination with carbide-forming micro-alloying elements like titanium, niobium, or vanadium and to scavenge C as much as possible to suppress the amount of cementite in the final microstructure. By optimizing other alloying elements, including Ti, Nb, and/or V, it is possible to obtain an almost uniform bainitic/bainitic-ferritic microstructure with only very little cementite.

Manganese is present in an amount of 1.20-3.50 weight %. Mn provides solid solution hardening and additionally is an essential element for promoting low carbon bainitic microstructures. Mn stabilizes austenite and delays the bainitic transformation at a given temperature, thus ensuring a good hardenability. A disadvantage of very high Mn contents is increased centreline segregation of continuously cast steel slabs and poor surface quality. Thus, preferably the Mn content is at most 2.20 weight %.

Silicon is present in an amount of 0.10-1.00 weight % to improve the strength of the steel through solid solution hardening. Furthermore, Si is beneficial to suppress the formation of cementite. However, when using higher amounts of Si the weldability and coatability of the steel deteriorates, so the amount of Si is preferably at most 0.95 weight %, and in preferred embodiments at most 0.70 or even at most 0.60 weight %.

Aluminium is present in an amount of 0.01-0.10 weight %. Al is a deoxidizing element and improves the cleanliness of the steel. At least 0.01 weight % Al is needed to be effective. However, Al may cause surface defects and therefore the Al content is at most 0.10 weight %, preferably even at most 0.05 weight %.

Titanium is present in an amount between 0.04 and 0.25 weight % because it provides hardenability and as a carbide forming element helps to form as low an amount of cementite as possible while providing precipitation strengthening via the formation of small Ti-based carbides. However, Ti also combines with N, S and C to form nitrides, and carbo-sulphides, depending on the specific chemical composition of the steel. For this reason, at least 0.04 weight % Ti is present to bind all the N and S in the steel and to have sufficient excess Ti to combine with C in the steel. When more than 0.25 weight % Ti is present, coarse Ti nitrides, carbo-nitrides, and carbides will be formed that are difficult to dissolve during reheating of the slab prior to hot rolling. Furthermore, these coarse Ti nitrides, carbo-nitrides, and carbides lead to a deterioration of the hole expansion capacity of the steel. Preferably 0.09 to 0.21 weight % Ti is present to always have enough Ti, but not risk strong coarsening. In certain embodiments 0.09-0.20 weight % Ti can be present, or even 0.11-0.20 weight % Ti. In other embodiments 0.12-0.18 weight % Ti can be present.

Boron is not needed to get the required properties of the steel, but can be present between 0.0005 and 0.005 weight %, that is between 5 and 50 ppm. B is very effective to enhance the hardenability of the steel, which means that a low carbon content and/or lower cooling rates can be used on the run out table while no or only little pro-eutectic ferrite is formed. B is also an alloying element that is very suitable to increase the yield strength. Preferably at least 10 ppm B is present to be sure not all B is formed into boron nitrides. When enough Ti is present, titanium nitrides are formed first, which prevents the formation of boron nitrides. This is preferred as this leaves boron free for an optimum contribution to hardenability of the steel.

Nitrogen is an inevitable element that should be as low as possible, at most 0.010 weight % N should be present. N forms titanium nitrides with Ti which act as dispersoids for austenite grain size control during reheating. However, too high N can lead to too much coarse TiN particles that can impair hole expansion capacity. Preferably the N content is 0.005 weight % (50 ppm) or less. A suitable minimum N content is 10 ppm.

Phosphorous is present as impurity; at most 0.10 weight % P should be present. When too much P is present, segregation at the grain boundaries is enhanced, resulting in lower toughness and lower weldability. Preferably, the P content is at most 0.01 weight %.

Sulphur is also present as impurity, at most 0.01 weight % should be present. During casting MnS particles are formed. Coarse MnS particles are undesirable because they elongate during hot rolling and impair hole expansion capacity and lead to poor sheared edge quality. The Ti in the steel can combine with S and C to form $Ti_4S_2C_2$ particles, dependent on the amount of Ti present. These $Ti_4S_2C_2$ particles are coarse particles that should be avoided as these also impair hole expansion capacity and sheared edge quality. Preferably at most 0.005 weight % S is present.

Several optional elements can be present in the steel.

Copper can be present in an amount of at most 1.5 weight %. Cu can promote low carbon bainite microstructures and provide solid solution hardening. Preferably at most 0.6 weight % Cu and more preferably at most 0.1 weight % Cu is present, when other elements provide the same results. In an embodiment no Cu is added to the steel as Cu is not an economically preferred element, so Cu is only present as impurity.

Chromium can be present in an amount of at most 1.0 weight %. Cr improves the strength of the steel mainly due to transformation strengthening via increased hardenability. Preferably at most 0.9 weight % Cr is present, and in certain embodiments at most 0.6 weight % Cr is present, or even at most 0.5 weight % Cr is present. In an embodiment no Cr is added to the steel, so Cr is only present as impurity.

Molybdenum can be present in an amount of at most 1.0 weight %. Mo increases hardenability and promotes a low carbon bainitic microstructure. Furthermore, since Mo is a carbide forming element, it can combine with Ti, Nb, or V to form composite carbide precipitates. These Mo-based composite carbides are known to be more thermally stable and subsequently less prone to coarsening. However, Mo is not an economically preferred element, therefore it is used in smaller amounts, preferably at most 0.9 weight %. In certain embodiments Mo is present in lower amounts, for instance at most 0.35 weight % or even at most 0.2 or at most 0.1 weight %, and in an embodiment no Mo is added to the steel, so Mo is present as an impurity. However, for other embodiments Mo has to be added, for instance up to 0.8 weight %, and preferably 0.005-0.7 wt. % Mo, more preferably 0.1-0.6 wt. % Mo, still more preferably 0.2-0.5 wt. % Mo is added.

Nickel can be added in an amount of at most 0.5 weight %. Ni improves toughness and hardenability at high strength levels and can mitigate the negative influence of Cu with regard to hot shortness. However, from a cost perspective at most 0.3 weight % Ni is advisable. Ni can be added up to 0.5 weight % to prevent hot shortness when Cu content exceeds 0.5 weight %. Preferably at most 0.3 weight % Ni is added, more preferably at most 0.2 or even at most 0.1 weight % Ni is added. In an embodiment no Ni is added to the steel, so Ni is only present as an impurity.

Vanadium can be present in the steel up to an amount of 0.3 weight %. However, V is a relatively costly element that is mostly used to replace Ti for its precipitation strengthening effect and to reduce cementite formation by forming vanadium carbides. As such preferably at most 0.2 weight % V is present in the steel. In certain embodiments V is present in an amount of at most 0.18 weight % or even at most 0.1 weight %. It is also a possibility that no V is added to the steel at all, so V is present as an impurity.

Niobium can be present in the steel up to 0.10 weight %. Nb improves the strength of the steel partly by precipitation hardening but foremost by grain refinement. However, for high amounts of Nb these effects are saturated. Therefore, preferably at most 0.08 weight % Nb is present. In certain embodiments at most 0.06 weight % Nb is present, and in preferred embodiments 0-0.04 weight % Nb is present, preferably 0.01-0.04 weight % Nb is present in the steel. In other embodiments no Nb is added to the steel, so Nb is present as an impurity.

Since Ti and Nb have the same function in the steel, Ti plus Nb should be at most 0.25 weight %.

In an analogous manner Cr plus Mo should be at most 1.0 weight %.

So as to get a high strength and a high hole expansion ratio the microstructure of the hot rolled steel must consist of (in volume %) at least 85% of bainite. Preferably the amount of bainite is as high as possible to obtain a hole expansion ratio that is as high as possible, and with the formation of bainite a small amount of cementite is formed (less than 5%). Further, small amounts of carbides, precipitates and inevitable inclusions may be present in the steel. Furthermore, the steel may contain at most 10% martensite plus retained austenite and preferably contains at most 5% martensite plus retained austenite.

Aim of the present invention is to obtain a predominantly bainitic microstructure that combines a sufficient degree of strength on the one hand with a sufficient degree of hole expansion capacity and tensile elongation on the other hand.

In this text the term bainite should be understood as to comprise Ferritic Bainite (FB), Granular Bainite (GB), Upper Bainite (UB), and Cementite-Free Bainite (CFB).

FIG. 1 shows schematically the definitions of the different morphologies of bainite used in this specification to describe the inventive and comparative examples, including Ferritic Bainite (FB), Granular Bainite (GB), Upper Bainite (UB), and Cementite-Free Bainite (CFB) and the individual building blocks, including irregular-shaped bainitic ferrite (Type 1), lath-like bainitic ferrite (Type 2), cementite (Fe3C), and martensite and/or retained austenite (M/RA):

These are all considered "composite" microstructures and the overall microstructure can be composed out of one of these "composite" microstructures or consist of a mixture of two or more of these "composite" microstructures. In turn, the "composite" microstructure can be composed out of one or more phase constituents or "building blocks". These building blocks are:

- irregular-shaped bainitic ferrite (BF, type 1) with a relatively low internal dislocation density,
- lath-like bainitic ferrite (BF, type 2) with a relatively high internal dislocation density,
- cementite ($Fe_3C$) present as relatively coarse particles on lath boundaries, grain boundaries, and/or to some extent also on prior austenite grain boundaries, and
- martensite and/or retained austenite (M/RA).

Most of these "building blocks" can be identified by means of Electron BackScatter Diffraction (EBSD), which in turn also allows the quantification of the area or volume fraction of these "building blocks". This holds for: (1) irregular-shaped bainitic ferrite (BF, type 1) with a relatively low internal dislocation density, (2) lath-like bainitic ferrite (BF, type 2) with a relatively high internal dislocation density, (3) martensite, and (4) retained austenite. The experimental methodology to carry of the identification and quantification of these "building blocks" via EBSD is explained in detail in the description of the Examples further in this document. Cementite cannot be accurately identified, let alone be quantified by means of EBSD. Light optical microscopy on polished cross sections of steel samples after etching for several seconds with a 4% Picral solution is commonly used to visualise cementite. However, due to the limited resolution of light optical microscopy and the small size of cementite particles, a very accurate quantification of the amount of cementite is impossible. This also holds when Scanning Electron Microscopy is used in combination with etched steel samples as the size of cementite particles is small and other microstructural features, such partially etched (sub)grain boundaries interfere with an accurate quantification of cementite. Hence, light optical microscopy in combination with Picral etching of steel samples was used foremost to assess if cementite is present in the microstructure. Cementite present in the overall microstructure is—predominantly—related to the presence of Upper Bainite (UB) consisting of lath-like bainitic ferrite (BF, type 2) and hence included in the volume fraction of this building block (lath-like bainitic ferrite (BF, type 2)).

Ferritic Bainite (FB) is composed out of irregular-shaped bainitic ferrite (BF, type 1) grains with a relatively low internal dislocation density. Excess carbon that cannot be in solution in the bainitic ferrite grains is consumed in the precipitation process with carbide-forming elements, including Ti, Nb, V, and/or Mo, resulting in Ferritic Bainite that only comprises irregular-shaped bainitic ferrite grains and contains no or hardly any cementite and/or M+RA. This type of bainite is favoured when the transformation occurs in a temperature region that provides sufficient kinetics for precipitation with aforementioned elements, in particular Ti. The irregular-shaped bainitic ferrite grains of this type of bainite are optimally strengthened with Ti-based carbide precipitates. This increased temperature range for formation of this type of bainite also explains its relatively low internal dislocation density as this type of bainite is formed predominantly via a diffusional mechanism.

Granular Bainite (GB) is composed out of irregular-shaped bainitic ferrite (BF, type 1) grains with a relatively low internal dislocation density. Excess carbon that cannot be in solution in the bainitic ferrite grains is only partially consumed in the precipitation process with carbide-forming elements, including Ti, Nb, V, and/or Mo, resulting in Granular Bainite (GB) that not only comprises irregular-shaped bainitic ferrite grains but also contains some M+RA in between irregular-shaped bainitic ferrite grains. This type of bainite is favoured when the transformation occurs in a temperature region that provides sufficient kinetics for carbon partitioning across the migrating ferrite-austenite transformation interface during the phase transformation process. The irregular-shaped bainitic ferrite grains of this type of bainite are only partially strengthened with Ti-based carbide precipitates. This increased temperature range for formation of this type of bainite also explains its relatively low internal dislocation density as this type of bainite is formed predominantly via a diffusional mechanism. The amount of martensite and/or retained austenite has to be limited since stress concentration around these phase constituents during shearing and forming operations can lead to premature crack nucleation.

Upper Bainite (UB) consists of lath-like bainitic ferrite (BF, type 2) with cementite on lath boundaries. This type of bainite is favoured by relatively low transformation temperatures and as a consequence this lath-like bainitic ferrite has a relatively high internal dislocation density, which—in general—will be higher than that of aforementioned irregular-shaped bainitic ferrite formed generally at more elevated transformation temperatures. Lath-like bainitic ferrite is formed predominantly via a more displacive oriented mechanism. The lower transformation temperatures for the formation of Upper Bainite (UB) are in conflict with optimum precipitation of carbon with carbide-forming elements, including Ti, Nb, V, and/or Mo as there is no sufficient kinetics under these conditions. As a consequence, Upper Bainite (UB) comprises a significant amount of cementite on lath boundaries. Upper Bainite (UB) has an increased resistance to crack propagation than Granular Bainite (GB), which is attributed to its considerably smaller (effective) crystallographic packet size (a packet corresponds with a crystallographic unit in bainite that consists of crystallographic sub units separated from each other by low-angle boundaries (<15°) and which has high-angle boundaries (≥15°) with other, neighbouring packets). The small crystallographic packet size of Upper Bainite (UB) and hence increased amount of high-angle boundaries are beneficial to arrest crack propagation. For this reason Upper Bainite (UB), consisting of lath-like bainitic ferrite with some inter-lath cementite is desirable for good hole expansion capacity. Since EBSD cannot (accurately) detect cementite and the amount of cementite present in the microstructure is predominantly present in between lath-like bainitic ferrite building blocks of Upper Bainite (UB), the amount of lath-like bainitic ferrite measured by means of EBSD also includes the amount of cementite present in the microstructure.

Cementite-Free Bainite (CFB) also consists of lath-like bainitic ferrite (BF, type 2). However, in contrast to Upper Bainite (UB), Cementite-Free Bainite (CFB) contains no cementite, but instead martensite and/or retained austenite on lath boundaries. Similar to Upper Bainite (UB), Cementite-free Bainite (CFB) is favoured by relatively low transformation temperatures and as a consequence the lath-like bainitic ferrite of this type of bainite has a relatively high internal dislocation density, which is similar to that of Upper Bainite (UB). Also Cementite-Free Bainite (CFB), like Upper Bainite (UB), will only be partially strengthened with Ti-based carbide precipitates.

As stated before, the aim of the present invention is to obtain a predominantly bainitic microstructure that combines a sufficient degree of strength on the one hand with a sufficient degree of hole expansion capacity and tensile elongation on the other hand. This bainitic microstructure is predominantly composed out of Ferritic Bainite (FB) and/or Upper Bainite (UB), and contains no or only a small amount of Granular Bainite (GB) or Cementite-Free Bainite (CFB).

These bainitic microstructures can be obtained by means of accelerated cooling after hot rolling and realising phase transformation at a low temperature on the run-out-table and/or coiler. The amount of martensite and/or retained austenite (M/RA) in between irregular-shaped bainitic ferrite grains or lath-like bainitic ferrite sheaves has to be controlled and the amount of martensite plus retained austenite (M+RA) should be limited to at most 10% or preferably at most 5%, or more preferably at most 3%, or even more preferably at most 2%, or still more preferably at most 1%, or most preferably no presence of martensite plus retained austenite.

Some martensite plus retained austenite (M+RA) can be tolerated and can be beneficial for strength, uniform elongation, and suppressing discontinuous yielding behaviour. However, too much martensite plus retained austenite can be at the expense of hole expansion capacity since these phase constituents promote nucleation of internal micro voids and cracks during punching. A too high density of these micro voids and cracks inside the steel close to the punched edge impairs hole expansion capacity as alignment and coalescence of these micro voids and cracks promotes early macroscopic fracture and failure.

The carbon-enriched areas from segregation during casting or—mostly— via carbon partitioning during phase transformation to obtain the aimed bainitic microstructure, can also lead to the formation of iron carbides or cementite ($Fe_xC_y$). This cementite is an inherent building block of Upper Bainite (UB) and a consequence of insufficient kinetics for optimum carbide precipitation at the transformation temperatures for the formation of Upper Bainite (UB). Nevertheless, the amount of excess carbon available to form cementite can be limited according to the present invention in such a manner that the amount of carbon and carbide-forming elements, including Ti, Nb, V, and Mo, are properly balanced. This is essential as a too high amount of cementite can lead to a deterioration of the formability in general and the hole expansion capacity in particular. However, some cementite in the overall bainitic microstructure is beneficial as a small amount of these rather small hard phase constituents may help to obtain a much improved sheared-edge quality. The presence of a small amount of cementite in the shear-affected zone and located on or close to the resulting sheared or punched edge can help to provide nucleation points for local failure. In this way, the presence of a small amount of cementite can help to promote macroscopic fracture and subsequent separation of the steel during shearing without excessive tearing, leaving behind a smoother surface of the sheared edge in general, and the fracture zone in particular of that sheared edge. This will be beneficial for the fatigue live of sheared edges and hence for the performance of automotive chassis components. However, too much cementite will lead to too much internal damage inside the steel, close to the sheared edge, which in turn will increase the risk of void coalescence that facilitates fracture propagation and ultimately leads to early macroscopic fracture and failure during—for instance—a hole expansion capacity test. In this context, a substantial amount of Upper Bainite (UB) will be beneficial as this type of bainite with its small crystallographic packet size has an increased resistance against crack propagation compared to Granular Bainite (GB) with a larger crystallographic packet size.

The inventors found that the amount of cementite and martensite plus retained austenite can be limited satisfactory for the present invention if the amount of and carbide-forming elements Ti, Nb, V, and Mo represented in weight % satisfy the equation of $$0.45 \leq \frac{C/12}{(Ti_sol/48+Nb/93+V/51+Mo/96)} \leq 2.2$$

with Ti_sol defined as the amount of free Ti in solution and expressed as $$Ti_{_sol} = Ti - \left(\frac{48}{14}\right) \times N$$

with the amount of Ti and N expressed in weight %.

Preferably, the lower limit of this equation is 0.55, more preferably 0.75, and the higher limit is preferably 2.1, more preferably 1.8, to further limit the amount of cementite and/or the amount of martensite plus retained austenite.

According to a first preferred embodiment a high strength steel with a medium high strength and very good hole expansion ratio is supplied. This steel has limited ranges for one or more of the following elements:

0.02-0.06 wt. % C, preferably 0.02-0.05 wt. % C;
1.30-2.20 wt. % Mn, preferably 1.30-2.00 wt. % Mn;
0.10-0.60 wt. % Si;
0.09-0.20 wt. % Ti, preferably 0.12-0.20 wt. % Ti;
0.0010-0.004 wt. % B, preferably 0.0010-0.003 wt. % B;

and/or contains limited ranges for one or more of the following optional elements:

0-0.5 wt. % Cu, preferably 0-0.1 wt. % Cu;
0-0.8 wt. % Cr, preferably 0-0.6 wt. % Cr;
0-0.35 wt. % Mo,
preferably 0-0.2 wt. % Mo, more preferably 0-0.1 wt. % Mo;
0-0.2 wt. % Ni, preferably 0-0.1 wt. % Ni;
0-0.18 wt. % V, preferably 0-0.1 wt. % V;
0-0.06 wt. % Nb,
preferably 0-0.04 wt. % Nb, more preferably 0.01-0.04 wt % Nb, wherein 1.6 wt. %≤Mn+Cr+2Mo≤2.4 wt. %, the steel having a microstructure consisting of (in volume %):

at least 85% bainite,
at most 5% martensite plus retained austenite,
more than 0% and at most 5% cementite, preferably 0.01-4% cementite, more preferably 0.02-3% cementite, even more preferably 0.02-2% cementite, most preferably 0.02-1% cementite,
inevitable amounts of inclusions, the sum adding up to 100 volume %.

Due to the limited amount of carbon the strength is not very high, but at the same time the amount of Mn+Cr+2Mo should be at least 1.6 weight %. In this way a microstructure can be obtained having at least 85% bainite, resulting in a very good hole expansion.

The limitations of all elements for this preferred embodiment are in line with the explanation for the choice of the amount for each element above, but chosen such that the strength of the steel is not too low as this would reduce the in-service performance of the steel nor too high as this would impair the hole expansion ratio and formability in general.

Preferably this steel has a microstructure with at most 4% martensite plus retained austenite, more preferably a microstructure with at most 3% martensite plus retained austenite, even more preferably at most 2% martensite plus retained austenite, still more preferably at most 1% martensite plus retained austenite, most preferably no presence of martensite plus retained austenite. Especially martensite enhances the strength but lowers the hole expansion of the steel, like retained austenite, so low amounts of both phase constituents should be present. No martensite is the best for formability.

The composition and microstructure of this preferred embodiment of the high strength steel strip according to the invention preferably has the following mechanical properties:

a yield strength of at least 570 and at most 900 MPa,
a tensile strength of at least 760 and at most 960 MPa,
a total elongation (A50) of at least 10% and/or
a hole expansion ratio (λ) value of at least 50%,
preferably a hole expansion ratio (λ) value of at least 60%,
more preferably a hole expansion ratio (λ) value of at least 70%,
most preferably a hole expansion ratio (λ) value of at least 80%.

This steel type is thus very suitable to provide an essentially bainitic steel having a 800 MPa strength and a very good hole expansion for demanding automotive parts.

According to a second preferred embodiment a high strength steel with an improved high strength and a good hole expansion ratio is supplied. This steel has limited ranges for one or more of the following elements:

0.03-0.12 wt. % C, preferably 0.04-0.09 wt. % C;
1.50-2.20 wt. % Mn, preferably 1.60-2.00 wt. % Mn;
0.20-0.95 wt. % Si, preferably 0.40-0.70 wt. % Si;
0.10-0.20 wt. % Ti, preferably 0.12-0.18 wt. % Ti;
0.0010-0.004 wt. % B, preferably 0.0010-0.003 wt. % B;

and/or contains limited ranges for one or more of the following optional elements:

0-0.5 wt. % Cu, preferably 0-0.1 wt. % Cu;
0-0.8 wt. % Cr, preferably 0-0.5 wt. % Cr;
0-0.8 wt. % Mo, preferably 0.005-0.7 wt. % Mo, more preferably 0.1-0.6 wt. % Mo, still more preferably 0.2-0.5 wt. % Mo;
0-0.2 wt. % Ni, preferably 0-0.1 wt. % Ni;
0-0.18 wt. % V, preferably 0-0.1 wt. % V;
0-0.06 wt. % Nb,
preferably 0-0.04 wt. % Nb, more preferably 0.01-0.04 wt % Nb, wherein Mn+Cr+2Mo≥2.3 wt. %, the steel having a microstructure consisting of (in volume %):

at least 90% bainite,
at most 5% martensite plus retained austenite,
more than 0% and at most 5% cementite, preferably 0.01-4% cementite, more preferably 0.02-3% cementite, even more preferably 0.02-2% cementite, most preferably 0.02-1% cementite,
inevitable amounts of inclusions, the sum adding up to 100 volume %.

Due to the higher amounts of alloying elements, especially the higher amount of C and the amount of Mn+Cr+2Mo that must be at least 2.3 weight %, a higher strength can be obtained. On the other hand, the microstructure contains at least 90% bainite, resulting in a somewhat lower hole expansion ratio.

Preferably this steel has a microstructure with at most 4% martensite plus retained austenite, preferably a microstructure with at most 3% martensite plus retained austenite, more preferably at most 2% martensite plus retained austenite, even more preferably at most 1% martensite plus retained austenite, most preferably no presence of martensite plus retained austenite. Here as well the amount of especially martensite and retained austenite should not be high so as not to impair the hole expansion ratio.

Preferably Cr+2Mo≥0.20 wt. %, more preferably Cr+2Mo≥0.30 wt. %, most preferably Cr+2Mo≥0.40 wt. %. A higher amount of Cr+2Mo is added so as to decrease the amount of Mn that must be added in an attempt to suppress centreline segregation, which can impair sheared edge quality or hole expansion capacity.

The composition and microstructure of this preferred embodiment of the high strength steel strip according to the invention preferably has the following mechanical properties:

- a yield strength of at least 670 and at most 990 MPa,
- a tensile strength of at least 960 and at most 1380 MPa,
- a total elongation (A50) of at least 9% and/or
- a hole expansion ratio (λ) value of at least 40%,
  - preferably a hole expansion ratio (λ) value of at least 45%
  - more preferably a hole expansion ratio (λ) value of at least 50%.

This steel type is thus very suitable to provide an essentially bainitic steel having a 1000 MPa strength and a good hole expansion for demanding automotive parts.

Preferably this steel type has a microstructure containing at least 60% lath-like bainitic ferrite and at most 40% irregular-shaped bainitic ferrite. As explained before, this is beneficial for providing a steel with a high strength and a high hole expansion ratio.

A car or truck component, such as an automotive chassis component, a component of the body in white, or a component of the frame or the subframe of a car or truck is preferably produced from the steel strip as described above when a good hole expansion ratio is required.

According to a second aspect of the invention a method of manufacturing a high strength steel as described above is provided. This method is given in claims 13 and 14. Especially the coiling temperatures of the manufacturing methods are important, as follows from the examples below.

The invention will now be elucidated with reference to the following non-limitative examples.

EXAMPLE 1

Steels A to R having the chemical compositions shown in Table 1.1 were hot-rolled to a thickness of circa 3.5 mm under the conditions given in Tables 1.2 and 1.3, producing steel sheets 1A to 17R and 18A to 33P, respectively. These steel sheets were produced with the aim to deliver a yield strength of at least 670 and at most 990 MPa, a tensile strength of at least 960 and at most 1380 MPa, a total (A50) tensile elongation of at least 9% and a hole expansion ratio λ of at least 40%.

Forged steel blocks were reheated to a temperature (RHT) of circa 1240° C. and held at this temperature for circa 45 minutes. After reheating the forged blocks were hot rolled and the thickness was reduced from 35 to circa 3.5 mm in 5 rolling passes. The temperature for the final rolling pass ($T_{IN}$) was in the range of 960 to 990° C. The finish rolling temperature (FRT) was in the range of 875 to 915° C. After the final rolling pass, the hot rolled steels were transferred to the run-out-table and actively cooled with a mixture of water and air to a temperature (Stop Accelerated Cooling Temperature or $T_{SAC}$) in the range of 450 to 495° C. at a cooling rate between 40 and 100° C. Next, the steels were transferred to a furnace to replicate slow coil cooling. This was done with furnace temperatures (CT—coiling temperature) of 450° C. (Table 1.2) and 500° C. (Table 1.3).

The EBSD measurements were conducted on cross sections parallel to the rolling direction (RD-ND plane) mounted in a conductive resin and mechanically polished to 1 μm. To obtain a fully deformation free surface, the final polishing step was conducted with colloidal silica (OPS).

The Scanning Electron Microscope (SEM) used for the EBSD measurements is a Zeiss Ultra 55 machine equipped with a Field Emission Gun (FEG-SEM) and an EDAX PEGASUS XM 4 HIKARI EBSD system. EBSD scans were collected on the RD-ND plane of the sheets. The samples were placed under a 70° angle in the SEM. The acceleration voltage was 15 kV with the high current option switched on. A 120 μm aperture was used and the typically working distance was 17 mm during scanning. To compensate for the high tilt angle of the sample, the dynamic focus correction was used during scanning.

The EBSD scans were captured using the TexSEM Laboratories (TSL) software: "Orientation Imaging Microscopy (OIM) Data Collection version 7.2". Typically, the following data collection settings were used: Hikari camera at 5×5 binning combined with background subtraction (standard mode). The scan area was in all cases located at a position of ¼ the sample thickness and care was taken to avoid as much as possible to include non-metallic inclusions in the scan area.

The EBSD scan size was in all cases 100×100 μm, with a step size of 0.1 μm, and a scan rate of approximately 100 frames per second. Fe(α) and Fe(γ) was used to index the Kikuchi patterns. The Hough settings used during data collections were: Binned pattern size of circa 96; theta set size of 1; rho fraction of circa 90; maximum peak count of 10; minimum peak count of 5; Hough type set to classic; Hough resolution set to low; butterfly convolution mask of 9×9; peak symmetry of 0.5; minimum peak magnitude of 10; maximum peak distance of 20.

The EBSD scans were evaluated with TSL OIM Analysis software version "8.0 x64 [12-14-16]". Typically, the data sets were 90° rotated over the RD axis to get the scans in the proper orientation with respect to the measurement orientation. A standard grain dilation clean-up was performed (Grain Tolerance Angle (GTA) of 5°, a minimum grain size of 5 pixels, criterion used that a grain must contain multiple rows for a single dilation iteration clean-up). Next to this, a pseudo-symmetry clean-up (GTA 5, axis ang 30°@111) was applied.

The EBSD Image Quality (IQ) maps were used to determine the amount of martensite. Area with a low IQ were identified as MS areas. For the given experimental conditions, typically the low IQ threshold was ≈0.4 of the peak-maximum position in the IQ histogram. The low IQ threshold was however manually checked for every scan to prevent including grain boundaries from granular bainite or upper bainitic areas in the martensite area fraction.

For calculation of EBSD Kernel Average Misorientation (KAM) maps the fifth nearest neighbour was used with a maximum misorientation of 5° (all points in kernel were used for KAM calculation). The Kernel Average Misorientation is regarded as a signature for the type of bainitic ferrite since Kernel Average Misorientation is a measure for the internal dislocation density. Areas with a relatively low internal dislocation density will predominantly correspond with areas that have a KAM value between 0 and 1° and are classified as irregular-shaped bainitic ferrite (BF, type 1) areas (building block of Ferritic Bainite (FB) and Granular Bainite (GB)). Areas with a relatively high internal dislocation density will predominantly correspond with areas that have KAM value between 1-5° and are classified as lath-like bainitic ferrite (BF, type 2) plus martensite. To determine the amount of lath-like bainitic ferrite (building block of Upper Bainite (UB) and Cementite-free Bainite (CFB)), the area fraction of martensite which was determined by the low-IQ criteria described in the previous paragraph, was subtracted from the area fraction having a KAM value between 1-5°. Since EBSD cannot (accurately) detect cementite and the amount of cementite present in the microstructure is predominantly present in between lath-like bainitic ferrite building blocks of Upper Bainite (UB), the amount of lath-like bainitic ferrite measured by means of EBSD also includes the amount of cementite present in the microstructure.

Prior to tensile and hole expansion capacity testing, the hot rolled sheets were sand blasted to remove the oxide layer. The reported tensile properties of sheets 1A to 17R in Table 1.2 and sheets 18A to 33P in Table 1.3 are based on A50 tensile geometry with tensile testing parallel to the rolling direction according to EN 10002-1/ISO 6892-1 (2009) (Rp=0.2% offset proof or yield strength; Rm=ultimate tensile strength; YR=yield ratio defined as Rp over Rm; Ag=uniform tensile elongation; A50=tensile elongation). To determine the hole expansion ratio λ, which is a criterion for stretch flangeability, three square samples (90×90 $mm^2$) were cut out from each sheet, followed by punching a hole of 10 mm in diameter in the sample with a flat punch. Hole expansion testing of the samples was done with upper burring. A conical punch of 60° was pushed up from below and the hole diameter $d_f$ was measured when a through-thickness crack formed. The hole expansion ratio λ was calculated using the formula below with $d_0$=10 mm:

$$\lambda = \frac{d_f - d_0}{d_0} \times 100\%$$

The λ values of sheets 1A to 17R and sheets 18A to 33P are given in Tables 1.2 and 1.3, respectively.

Steels A to G are inventive. For these steels the atomic ratio A defined as the amount of C by the sum of carbide forming elements Nb, V, Ti, and Mo according to $$A = \frac{C/12}{(Ti_sol/48 + Nb/93 + V/51 + Mo/96)}$$

is between or equal to 0.45 and 2.2 with aforementioned elements in above equation expressed in weight % and the amount of titanium in solution Ti_sol defined as $$Ti_{_sol} = Ti - \left(\frac{48}{14}\right) \times N$$

with N given in weight %. Inventors found that for the steels A-F, where the atomic ratio is at least 0.6 and at most 1.6 as shown in Table 1.1, the amount of martensite plus retained austenite is at most 0.5%, as shown in Table 1.3 with the process settings as indicated in Table 1.3, and the amount of martensite plus retained austenite is at most 0.7% as indicated in Table 1.2, with the process settings as indicated in Table 1.2. The examples also show that no martensite plus retained austenite has to be present.

The steels A to G with the compositions listed in Table 1.1 and with atomic ratio A between or equal to 0.45 and 2.2 are all considered inventive examples and the corresponding inventive steel sheets 1A to 7G in Table 1.2 and 18A to 24G in Table 1.3 all have a yield strength of at least 670 and at most 990 MPa, a tensile strength of at least 960 and at most 1380 MPa, an A50 tensile elongation of at least 9%, and a hole expansion ratio λ of at least 40%.

These properties are derived from microstructures that consist of a mixture of Ferritic Bainite (FB) and Upper Bainite (UB) with the latter being the dominant phase constituent with a volume fraction of 60% or higher and typically in the range of 65 to 80%. As a consequence, all these microstructures show evidence of the presence of cementite based on visual inspection with light-optical microscopy. Though an accurate quantification of the amount of cementite is practically impossible, the fraction cementite for all inventive examples is estimated to be at most 5%. The volume fraction Ferritic Bainite (FB) is for these inventive examples considerably lower, i.e., roughly 20 to 35%. The amount of martensite plus retained austenite (M+RA) is in all cases below 1% and in some cases no martensite and/or retained austenite is present. Hence, the amount of Granular Bainite (GB) and Cementite-Free Bainite (CFB) in all these inventive examples is not considered as significant.

The steels H to R with the compositions listed in Table 1.1 and with atomic ratio A above 2.2 are all considered comparative examples and the corresponding steel sheets 8H to 17R in Table 1.2 and 25H to 33P in Table 1.3 have either a too high yield strength, or a tensile strength below 960 MPa, or too low formability in terms of an A50 tensile elongation below 9% or a hole expansion ratio λ below 40%.

These properties are derived from microstructures that, like the inventive examples, also consist of a mixture of Ferritic Bainite (FB) and Upper Bainite (UB) but do have some essential differences with the inventive examples, either with regard to increased cementite ($Fe_3C$) fraction or increased martensite+retained-austenite (M+RA). These differences are here below highlighted for:

- comparative examples 10J to 12L in Table 1.2 and comparative examples 27J to 29L in Table 1.3, and
- comparative examples 13M to 17R in Table 1.2 and 30M to 33P in Table 1.3.

In contrast to the inventive examples, the fraction cementite for comparative examples 10J, 11K, and 12L in Table 1.2 and comparative examples 27J, 28K, and 29L in Table 1.3 is estimated to be more than 5%. It is believed that this amount of cementite impairs formability, i.e. tensile elongation and/or hole-expansion capacity.

For comparative examples 13M to 17R in Table 1.2 and 30M to 33P in Table 1.3 the amount of Upper Bainite (UB) is considerably lower with typical values between 50 to 60% and the amount of Ferritic Bainite (FB) is considerably higher with typical values around 35 to 55%. For these comparative samples, the fraction cementite is estimated to be more than 0% and at most 5% as in case of the inventive examples. However, microscopic analysis indicates that for comparative examples 3M to 17R in Table 1.2 and 30M to 33P in Table 1.3 the carbon has led to the formation of martensite and/or retained-austenite. The amount of martensite plus retained austenite (M+RA) is in all cases above 1% and in most cases the amount of martensite plus retained austenite is even (well) above 4%. This indicates increased amount of Granular Bainite (GB) and Cementite-Free Bainite (CFB) for these comparative examples. The lower fraction of Upper Bainite (UB) with an increase in Ferritic Bainite (FB) and the increased amount of GB and/or CFB is believed to contribute to a lower hole expansion capacity for these comparative examples than observed for the inventive examples in this case.

To achieve a steel with a yield strength of at least 670 and at most 990 MPa, a tensile strength of at least 960 and at most 1380 MPa, an A50 tensile elongation of at least 9%, and a hole expansion ratio λ of at least 40%, the microstructure of the steel should comprise:

at least 90% Bainite, or preferably at least 95% Bainite, or more preferably at least 97% Bainite, or still more preferably at least 98% Bainite, or most preferably at least 99% Bainite, wherein the Bainite consists of a mixture of predominantly Upper Bainite (UB) and a minor contribution of Ferritic Bainite (FB) that are reinforced with Ti-based composite carbide precipitates and in which the overall microstructure of the steel consists of:

at least 60% lath-like bainitic ferrite (BF, type 2), including more than 0% and at most 5% cementite, preferably 0.01-4% cementite, more preferably 0.02-3% cementite, even more preferably 0.02-2% cementite, most preferably 0.02-1% cementite, at most 40% irregular-shaped bainitic ferrite (BF, type 1), and at most 5% martensite plus retained austenite (M+RA), and preferably at most 3% martensite plus retained austenite, more preferably at most 2% martensite plus retained austenite, even more preferably at most 1% martensite plus retained austenite, most preferably no presence of martensite plus retained austenite.

TABLE 1.1

Compositions of steels.

| Alloy | C wt % | Si wt % | Mn wt % | Al wt % | P wt % | S ppm | Ti wt % | Nb wt % | V wt % | Mo wt % | Cr wt % | B ppm | N ppm | Cr + 2 Mo wt % | Mn + Cr + 2 Mo wt % | Ti_sol wt % | Atomic ratio* C/[Ti_sol + Nb + V + Mo] | Example |
|---|---|---|---|---|---|---|---|---|---|---|---|---|---|---|---|---|---|---|
| A | 0.061 | 0.521 | 1.916 | 0.063 | 0.013 | 10 | 0.162 | 0.001 | 0.006 | 0.007 | 0.896 | 20 | 47 | 0.910 | 2.826 | 0.146 | 1.567 | Inventive |
| B | 0.061 | 0.507 | 1.897 | 0.072 | 0.011 | 10 | 0.158 | 0.001 | 0.005 | 0.150 | 0.303 | 19 | 49 | 0.603 | 2.500 | 0.141 | 1.103 | Inventive |
| C | 0.061 | 0.511 | 1.912 | 0.066 | 0.011 | 8 | 0.163 | 0.001 | 0.005 | 0.250 | 0.010 | 22 | 47 | 0.510 | 2.422 | 0.147 | 0.880 | Inventive |
| D | 0.061 | 0.948 | 1.919 | 0.066 | 0.012 | 13 | 0.165 | 0.002 | 0.005 | 0.244 | 0.001 | 24 | 46 | 0.489 | 2.408 | 0.149 | 0.882 | Inventive |
| E | 0.043 | 0.514 | 1.904 | 0.066 | 0.011 | 11 | 0.156 | 0.002 | 0.006 | 0.253 | 0.002 | 21 | 45 | 0.508 | 2.412 | 0.141 | 0.627 | Inventive |
| F | 0.044 | 0.517 | 1.929 | 0.070 | 0.012 | 10 | 0.181 | 0.002 | 0.005 | 0.245 | 0.002 | 24 | 44 | 0.492 | 2.421 | 0.166 | 0.598 | Inventive |
| G | 0.049 | 0.501 | 1.900 | 0.077 | 0.014 | 8 | 0.159 | 0.002 | 0.007 | 0.205 | 0.000 | 25 | 46 | 0.410 | 2.310 | 0.143 | 0.774 | Inventive |
| H | 0.121 | 0.207 | 1.913 | 0.073 | 0.013 | 4 | 0.122 | 0.001 | 0.006 | 0.253 | 0.000 | 3 | 41 | 0.506 | 2.419 | 0.108 | 2.011 | Inventive |
| I | 0.124 | 0.207 | 1.605 | 0.069 | 0.013 | 11 | 0.122 | 0.001 | 0.006 | 0.256 | 0.248 | 2 | 52 | 0.760 | 2.365 | 0.104 | 2.083 | Inventive |
| **J** | **0.151** | 0.209 | 1.927 | 0.072 | 0.012 | 7 | 0.122 | 0.001 | 0.006 | 0.206 | 0.000 | 1 | 55 | 0.412 | 2.339 | 0.103 | **2.847** | Comparative |
| **K** | **0.151** | 0.201 | 1.494 | 0.067 | 0.012 | 11 | 0.118 | 0.001 | 0.005 | 0.253 | 0.243 | 2 | 49 | 0.749 | 2.243 | 0.101 | **2.595** | Comparative |
| **L** | **0.149** | 0.690 | 1.885 | 0.072 | 0.011 | 9 | 0.120 | 0.001 | 0.006 | 0.004 | 0.299 | 1 | 54 | 0.307 | 2.192 | 0.101 | **5.460** | Comparative |
| **M** | 0.120 | 0.209 | 1.910 | 0.069 | 0.012 | 15 | 0.116 | 0.029 | 0.005 | 0.003 | 0.787 | 1 | 50 | 0.793 | 2.703 | 0.099 | **3.994** | Comparative |
| **N** | **0.141** | 0.211 | 1.908 | 0.065 | 0.011 | 15 | 0.113 | 0.002 | 0.006 | 0.004 | 0.782 | 1 | 54 | 0.790 | 2.698 | 0.094 | **5.493** | Comparative |
| **O** | **0.140** | 0.205 | 1.907 | 0.062 | 0.011 | 14 | 0.115 | 0.001 | 0.004 | 0.007 | 0.308 | 2 | 51 | 0.322 | 2.229 | 0.098 | **5.294** | Comparative |
| **P** | **0.142** | 0.207 | 1.904 | 0.062 | 0.011 | 17 | 0.085 | 0.001 | 0.004 | 0.104 | 0.787 | 3 | 55 | 0.995 | 2.899 | 0.066 | **4.645** | Comparative |
| **Q** | 0.105 | 0.206 | 1.886 | 0.065 | 0.013 | 12 | 0.112 | 0.001 | 0.006 | 0.011 | 0.830 | 2 | 58 | 0.852 | 2.738 | 0.092 | **4.052** | Comparative |
| **R** | 0.122 | 0.210 | 1.927 | 0.060 | 0.006 | 2 | 0.113 | 0.001 | 0.006 | 0.006 | 0.826 | 1 | 63 | 0.838 | 2.765 | 0.091 | **4.872** | Comparative |

Atomic ratio C/[Ti_sol + Nb + V + Mo] with elements expressed in weight % is defined as:

$$\frac{C/12}{(\text{Ti_sol}/48 + Nb/93 + V/51 + Mo/96)}$$

with the amount of free Ti not bound to N expressed as $$Ti_{_sol} = Ti - \left(\frac{48}{14}\right) \times N$$

with Ti and N in weight %

TABLE 1.2

Process settings, microstructures, and steel properties with coiling at 450° C.

| | | PROCESS SETTINGS | | | | | MICROSTRUCTURE | | | | | |
|---|---|---|---|---|---|---|---|---|---|---|---|---|
| | | | | | | | BF (%) | | M + RA | $Fe_3C$ | | |
| Steel | Alloy | RHT (° C.) | $T_{in}$ (° C.) | FRT (° C.) | $T_{SAC}$ (° C.) | CT (° C.) | Type1 | Type2 building blocks | (%) | (–) | FB composites | GB |
| 1 | A | 1240 | 985 | 895 | 460 | 450 | 21.0 | 79.0 | 0.0 | yes– | □ | — |
| 2 | B | 1240 | 990 | 900 | 480 | 450 | 29.0 | 71.0 | 0.0 | yes– | □ | — |
| 3 | C | 1240 | 980 | 890 | 480 | 450 | 32.0 | 68.6 | 0.4 | yes– | □ | — |

TABLE 1.2-continued

Process settings, microstructures, and steel properties with coiling at 450° C.

| | | | | | | | | | | | | |
|---|---|---|---|---|---|---|---|---|---|---|---|---|
| 4 | D | 1240 | 980 | 900 | 480 | 450 | 24.0 | 75.3 | 0.7 | yes− | □ | — |
| 5 | E | 1240 | 980 | 895 | 475 | 450 | 24.0 | 76.0 | 0.0 | yes− | □ | — |
| 6 | F | 1240 | 980 | 900 | 490 | 450 | 34.0 | 66.0 | 0.0 | yes− | □ | — |
| 7 | G | 1240 | 970 | 900 | 480 | 450 | 21.9 | 77.6 | 0.5 | yes− | □ | — |
| 8 | H | 1240 | 970 | 885 | 465 | 450 | 20.0 | 79.0 | 1.0 | yes− | □ | — |
| 9 | I | 1240 | 975 | 885 | 480 | 450 | 26.6 | 73.4 | 0.0 | yes− | □ | — |
| 10 | **J** | 1240 | 980 | 890 | 465 | 450 | 34.0 | 66.0 | 0.0 | **yes+** | □ | — |
| 11 | **K** | 1240 | 970 | 890 | 470 | 450 | 22.1 | 78.0 | 0.0 | **yes+** | □ | — |
| 12 | **L** | 1240 | 970 | 875 | 450 | 450 | 13.2 | 86.9 | 0.0 | **yes+** | □ | — |
| 13 | **M** | 1240 | 970 | 880 | 450 | 450 | 35.0 | 56.0 | 9.0 | yes− | □ | ○ |
| 14 | **O** | 1240 | 960 | 875 | 465 | 450 | 38.0 | 59.7 | 2.3 | yes− | □ | ○ |
| 15 | **P** | 1240 | 975 | 880 | 450 | 450 | 40.0 | 53.9 | 6.1 | yes− | □ | ○ |
| 16 | **Q** | 1220 | 960 | 875 | 460 | 450 | 37.0 | 54.5 | 8.5 | yes− | □ | ○ |
| 17 | **R** | 1220 | 965 | 875 | 460 | 450 | 36.0 | 59.9 | 4.1 | yes− | □ | ○ |

| | MICROSTRUCTURE | | MECHANICAL PROPERTIES | | | | | | | |
|---|---|---|---|---|---|---|---|---|---|---|
| Steel | UB composites | CFB composites | t (mm) | Rp (MPa) | Rm (MPa) | YR (a.u.) | Ag (%) | A50 (%) | λ (%) | Example |
| 1 | ■ | — | 3.56 | 962 | 1056 | 0.91 | 4.1 | 10.0 | 46 | Inventive |
| 2 | ■ | — | 3.52 | 902 | 993 | 0.91 | 3.5 | 9.6 | 59 | Inventive |
| 3 | ■ | — | 3.55 | 925 | 993 | 0.93 | 3.5 | 9.3 | 63 | Inventive |
| 4 | ■ | — | 3.79 | 967 | 1047 | 0.92 | 4.6 | 10.9 | 40 | Inventive |
| 5 | ■ | — | 3.53 | 898 | 968 | 0.93 | 4.7 | 11.7 | 82 | Inventive |
| 6 | ■ | — | 3.62 | 929 | 997 | 0.93 | 3.8 | 11.0 | 52 | Inventive |
| 7 | ■ | — | 3.54 | 935 | 998 | 0.94 | 4.4 | 11.1 | 67 | Inventive |
| 8 | ■ | — | 3.57 | 939 | 967 | 0.97 | 3.0 | 9.5 | 77 | Inventive |
| 9 | ■ | — | 3.48 | 889 | 967 | 0.92 | 2.9 | 9.0 | 74 | Inventive |
| 10 | ■ | — | 3.45 | 951 | 994 | 0.96 | 2.6 | **8.1** | **38** | Comparative |
| 11 | ■ | — | 3.48 | 954 | 1007 | 0.95 | 2.8 | **7.2** | **39** | Comparative |
| 12 | ■ | — | 3.30 | **1066** | 1120 | 0.95 | 3.2 | **8.4** | **38** | Comparative |
| 13 | □ | ○ | 3.36 | 853 | **944** | 0.90 | 4.7 | 9.6 | **36** | Comparative |
| 14 | ■ | ○ | 3.23 | 744 | **836** | 0.89 | 4.9 | 10.4 | **39** | Comparative |
| 15 | □ | ○ | 3.45 | 700 | **953** | 0.73 | 7.4 | 13.1 | **32** | Comparative |
| 16 | □ | ○ | 3.32 | 733 | **912** | 0.80 | 7.4 | 12.7 | **35** | Comparative |
| 17 | □ | ○ | 3.18 | 804 | **948** | 0.85 | 6.7 | 11.8 | **32** | Comparative |

RHT = Reheating Temperature
$T_{in}$ = Entry Temperature last rolling pass
FRT = Finish Rolling Temperature
$T_{SAC}$ = Stop Accelerated Cooling Temperature
CT = Coiling Temperature
yes− = Estimated to be more than 0% and at most 5%
yes+ = Estimated to be more than 5%
BF, Type1 = Bainitic Ferrite with a Kernel Average Misorientation of 0 to 1 degrees
BF, Type2 = Bainitic Ferrite with a Kernel Average Misorientation of 1 to 5 degrees
M + RA = Martensite + Retained Austenite
$Fe_3C$ = Cementite
FB = Ferritic Bainite
GB = Granular Bainite
UB = Upper Bainite
CFB = Cementite-Free Bainite
— No significant presence
○ Vol. fraction estimated ≤25%
□ Vol. fraction estimated 25-60%
■ Vol. fraction estimated ≥60%

TABLE 1.3

Process settings, microstructures, and steel properties with coiling at 500° C.

| | | PROCESS SETTINGS | | | | | MICROSTRUCTURE | | | | | |
|---|---|---|---|---|---|---|---|---|---|---|---|---|
| | | | | | | | BF (%) | | M + RA | $Fe_3C$ | | |
| Steel | Alloy | RHT (° C.) | $T_{in}$ (° C.) | FRT (° C.) | $T_{SAC}$ (° C.) | CT (° C.) | Type1 | Type2 building blocks | (%) | (−) | FB composites | GB composites |
| 18 | A | 1240 | 980 | 900 | 460 | 500 | 21.0 | 79.0 | 0.0 | yes− | □ | — |
| 19 | B | 1240 | 985 | 905 | 470 | 500 | 29.0 | 70.8 | 0.2 | yes− | □ | — |
| 20 | C | 1240 | 985 | 890 | 480 | 500 | 24.0 | 75.5 | 0.5 | yes− | □ | — |
| 21 | D | 1240 | 985 | 900 | 470 | 500 | 22.0 | 78.0 | 0.0 | yes− | □ | — |
| 22 | E | 1240 | 985 | 900 | 490 | 500 | 32.0 | 67.5 | 0.5 | yes− | □ | — |
| 23 | F | 1240 | 980 | 900 | 495 | 500 | 30.0 | 70.0 | 0.0 | yes− | □ | — |

TABLE 1.3-continued

Process settings, microstructures, and steel properties with coiling at 500° C.

| | | | | | | | | | | | | |
|---|---|---|---|---|---|---|---|---|---|---|---|---|
| 24 | G | 1240 | 985 | 915 | 465 | 500 | 21.6 | 78.4 | 0.0 | yes− | □ | — |
| 25 | H | 1240 | 960 | 885 | 460 | 500 | 23.4 | 76.1 | 0.5 | yes− | □ | — |
| 26 | I | 1240 | 960 | 875 | 490 | 500 | 24.0 | 76.0 | 0.0 | yes− | □ | — |
| 27 | **J** | 1240 | 970 | 885 | 460 | 500 | 23.9 | 76.2 | 0.0 | **yes+** | □ | — |
| 28 | **K** | 1240 | 990 | 885 | 485 | 500 | 25.7 | 74.5 | 0.0 | **yes+** | □ | — |
| 29 | **L** | 1240 | 975 | 895 | 455 | 500 | 14.3 | 85.7 | 0.0 | **yes+** | □ | — |
| 30 | **M** | 1240 | 985 | 900 | 460 | 500 | 42.0 | 50.5 | 7.5 | yes− | □ | ○ |
| 31 | **N** | 1240 | 985 | 895 | 450 | 500 | 38.0 | 59.8 | 2.2 | yes− | □ | ○ |
| 32 | **O** | 1240 | 975 | 900 | 465 | 500 | 53.0 | 45.6 | 1.4 | yes− | □ | ○ |
| 33 | **P** | 1240 | 990 | 895 | 450 | 500 | 42.0 | 51.5 | 6.5 | yes− | □ | ○ |

| | MICROSTRUCTURE | | MECHANICAL PROPERTIES | | | | | | | |
|---|---|---|---|---|---|---|---|---|---|---|
| Steel | UB composites | CFB composites | t (mm) | Rp (MPa) | Rm (MPa) | YR (a.u.) | Ag (%) | A50 (%) | λ (%) | Example |
| 18 | ■ | — | 3.57 | 963 | 1053 | 0.91 | 4.6 | 10.8 | 53 | Inventive |
| 19 | ■ | — | 3.54 | 944 | 1015 | 0.93 | 4.1 | 9.8 | 48 | Inventive |
| 20 | ■ | — | 3.50 | 925 | 990 | 0.93 | 4.3 | 10.0 | 64 | Inventive |
| 21 | ■ | — | 3.65 | 987 | 1058 | 0.93 | 3.3 | 9.6 | 43 | Inventive |
| 22 | ■ | — | 3.65 | 884 | 964 | 0.92 | 4.8 | 11.2 | 78 | Inventive |
| 23 | ■ | — | 3.56 | 914 | 990 | 0.92 | 4.9 | 12.0 | 54 | Inventive |
| 24 | ■ | — | 3.47 | 965 | 1002 | 0.96 | 4.3 | 10.9 | 48 | Inventive |
| 25 | ■ | — | 3.54 | 899 | 963 | 0.93 | 4.4 | 9.8 | 45 | Inventive |
| 26 | ■ | — | 3.47 | 937 | 991 | 0.95 | 4.3 | 9.5 | 60 | Inventive |
| 27 | ■ | — | 3.51 | 891 | **951** | 0.94 | 4.0 | **8.2** | 50 | Comparative |
| 28 | ■ | — | 3.47 | 957 | 1005 | 0.95 | 3.0 | **7.6** | 69 | Comparative |
| 29 | ■ | — | 3.32 | **1073** | 1110 | 0.97 | 3.9 | **6.9** | **36** | Comparative |
| 30 | □ | ○ | 3.49 | 801 | **942** | 0.85 | 6.1 | 11.4 | **36** | Comparative |
| 31 | □ | ○ | 3.40 | 710 | 974 | 0.73 | 7.8 | 13.9 | **36** | Comparative |
| 32 | □ | ○ | 3.46 | 771 | **851** | 0.91 | 7.3 | 15.6 | **38** | Comparative |
| 33 | □ | ○ | 3.42 | 697 | 962 | 0.72 | 7.1 | 12.9 | **34** | Comparative |

RHT = Reheating Temperature
$T_{in}$ = Entry Temperature last rolling pass
FRT = Finish Rolling Temperature
$T_{SAC}$ = Stop Accelerated Cooling Temperature
CT = Coiling Temperature
yes− = Estimated to be more than 0% and at most 5%
yes+ = Estimated to be more than 5%
BF, Type1 = Bainitic Ferrite with a Kernel Average Misorientation of 0 to 1 degrees
BF, Type2 = Bainitic Ferrite with a Kernel Average Misorientation of 1 to 5 degrees
M + RA = Martensite + Retained Austenite
$Fe_3C$ = Cementite
FB = Ferritic Bainite
GB = Granular Bainite
UB = Upper Bainite
CFB = Cementite-Free Bainite
— No significant presence
○ Vol. fraction estimated ≤25%
□ Vol. fraction estimated 25-60%
■ Vol. fraction estimated ≥60%

EXAMPLE 2

Steels A to J having the chemical compositions shown in Table 2.1 were hot-rolled to a thickness of circa 3.5 mm under the conditions given in Tables 2.2, 2.3, and 2.4, producing steel sheets 1A to 6F, 7A to 16J, and 17G to 20J, respectively. These steel sheets were produced with the aim to deliver a yield strength of at least 570 and at most 900 MPa, a tensile strength of at least 760 and at most 960 MPa, a total (A50) tensile elongation of at least 10% and a hole expansion ratio λ of at least 50%.

Forged steel blocks were reheated to a temperature (RHT) of circa 1240° C. and held at this temperature for circa 45 minutes. After reheating the forged blocks were hot rolled and the thickness was reduced from 35 to circa 3.5 mm in 5 rolling passes. The temperature for the final rolling pass ($T_{IN}$) was in the range of 960 to 990° C. The finish rolling temperature (FRT) was in the range of 870 to 905° C. After the final rolling pass, the hot rolled steels were transferred to the run-out-table and actively cooled with a mixture of water and air to a temperature (Stop Accelerated Cooling Temperature or $T_{SAC}$) at a cooling rate between 40 and 100° C. After cooling on the run-out-table, the steels were transferred to a furnace to replicate slow coil cooling with furnace temperatures (CT—coiling temperature) of 450° C. (Table 2.2), 550° C. (Table 2.3), and 500° C. (Table 2.4). The exit run-out-table temperatures ($T_E$) for these trials were in the range of 465 to 510° C., 540 to 580° C., and 500 to 550° C., respectively.

The EBSD procedures used to determine the amount of irregular-shaped bainitic ferrite, lath-like bainitic ferrite, martensite, and retained austenite are identical to those described in EXAMPLE 1.

Prior to tensile and hole expansion capacity testing, the hot rolled sheets were sand blasted to remove the oxide layer. The reported tensile properties of sheets 1A to 6F in Table 1.2, and sheets 7A to 16J in Table 2.3, and sheets 17G to 20J in Table 2.4 are based on A50 tensile geometry with tensile testing parallel to the rolling direction according to EN 10002-1/ISO 6892-1 (2009) (Rp=0.2% offset proof or yield strength; Rm=ultimate tensile strength; YR=yield ratio defined as Rp over Rm; Ag=uniform tensile elongation; A50=tensile elongation). To determine the hole expansion ratio λ, which is a criterion for stretch flangeability, three square samples (90×90 $mm^2$) were cut out from each sheet, followed by punching a hole of 10 mm in diameter in the sample with a flat punch. Hole expansion testing of the samples was done with upper burring. A conical punch of 60° was pushed up from below and the hole diameter $d_f$ was measured when a through-thickness crack formed. The hole expansion ratio λ was calculated using the formula below with $d_0$=10 mm:

$$\lambda = \frac{d_f - d_0}{d_0} \times 100\%$$

The λ values of sheets 1A to 6F, and sheets 7A to 16J, and sheets 17G to 20J are given in Tables 2.2, 2.3, and 2.4, respectively.

Steels A to I are inventive. For these steels the atomic ratio A defined as the amount of C by the sum of carbide forming elements Nb, V, Ti, and Mo according to $$A = \frac{C/12}{(Ti_sol/48 + Nb/93 + V/51 + Mo/96)}$$

is between or equal to 0.45 and 2.2 with aforementioned elements in above equation expressed in weight % and the amount of titanium in solution Ti_sol defined as $$Ti_{_sol} = Ti - \left(\frac{48}{14}\right) \times N$$

with N given in weight %. Inventors found that for the steels A-I, where the atomic ratio is at least 0.8 and at most 1.4 as shown in Table 2.1, the amount of martensite plus retained austenite is at most 0.2%, as shown in Table 2.2 with the process settings as indicated in Table 2.2, and the amount of martensite plus retained austenite is at most 3.9% as indicated in Table 2.3, with the process settings as indicated in Table 2.3, or at most 4.2% as indicated in Table 2.4 with the process settings as indicated in Table 2.4. The examples also show that no martensite plus retained austenite has to be present, see Table 2.2.

The steels A to I with the compositions listed in Table 2.1 and with atomic ratio A between or equal to 0.45 and 2.2 are all considered inventive examples and the corresponding inventive steel sheets 1A, 2B and 4D to 6F in Table 2.2, 7A to 15I in Table 2.3, and 17G to 19I in Table 2.4 all have a yield strength of at least 570 and at most 900 MPa, a tensile strength of at least 760 and at most 960 MPa, an A50 tensile elongation of at least 10%, and a hole expansion ratio λ of at least 50%. Steel J with the composition listed in Table 2.1 and with atomic ratio A well above 2.2 is considered a comparative example and the corresponding steel sheets 16J in Table 2.3 and 20J in Table 2.4 are considered as comparative examples since the hole expansion ratio λ is below 50%.

It is preferred to use a coiling temperature between 520 and 570° C. for the production of steels with a yield strength of at least 570 and at most 900 MPa, a tensile strength of at least 760 and at most 960 MPa, a total (A50) tensile elongation of at least 10% and a hole expansion ratio λ of at least 50%. A comparison between the data corresponding with inventive examples given in Tables 2.2, 2.3, and 2.4 shows that with a coiling temperature of 550° C. the A50 tensile elongation is substantially higher than with a lower coiling temperature of 450 or 500° C. while still providing excellent hole expansion capacity and good values for yield and tensile strength.

Microstructures of Examples 1A to 6F Coiled at 450° C. (Table 2.2):

The properties of all the inventive examples are derived from microstructures that consist of a mixture of Ferritic Bainite (FB) and Upper Bainite (UB) with the latter being the dominant phase constituent with a volume fraction of 60% or higher and typically in the range of 60 to 75%. As a consequence, all these microstructures show evidence of the presence of cementite based on visual inspection with light-optical microscopy. The volume fraction Ferritic Bainite (FB) is for these inventive examples considerably lower, i.e., roughly 25 to 40%. The amount of martensite plus retained austenite (M+RA) is in all cases well below 1% and in some cases no martensite and/or retained austenite is present. Hence, the amount of Granular Bainite (GB) and Cementite-Free Bainite (CFB) in all these inventive examples is not significant.

Though the composition of steel C without an intended boron addition above 5 ppm is considered as inventive for the present invention, when used in combination with a coiling temperature of 450° C. the corresponding steel sheet 3C (Table 2.2) has a too low tensile strength with a value that falls below 760 MPa due to insufficient hardenability. This makes steel sheet 3C a comparative example for the present invention. The too low strength is explained by the increased presence of Ferritic Bainite (FB) at the expense of Upper Bainite (UB) due to the absence of an intended boron addition above 5 ppm and a subsequent lower degree of hardenability. Since the internal dislocation density of Ferritic Bainite (FB) is considerably lower than that of Upper Bainite (UB) and its crystallographic packet size is larger, the strength is compromised.

Microstructures of Examples 7A to 16J Coiled at 550° C. (Table 2.3):

Coiling between 520 and 570° C. is the preferred option as stated before. The properties of all the inventive examples obtained with coiling at 550° C. are derived from microstructures that consist of a mixture of Ferritic Bainite (FB), Granular Bainite (GB), and Upper Bainite (UB) with the former (FB) being the dominant phase constituent with a volume fraction of 60% or higher and typically in the range of 60 to 75%. The volume fraction of Upper Bainite (UB) is for these inventive examples considerably lower, i.e., roughly 25 to 40%. This minor presence of Upper Bainite is associated with the presence of some cementite based on visual inspection with light-optical microscopy after etching with a 4% Picral solution to selectively outline cementite. The amount of martensite plus retained austenite (M+RA) is in all cases below 4%, and in most cases below 3%. The lowest amount of martensite plus retained austenite (M+RA) measured for the inventive examples is 0.5%.

Since the amount of martensite plus retained austenite is so low, the amount of Granular Bainite (GB) in all these inventive examples is assessed as relatively small (≤25%) and since the coiling temperature used is relatively high, the amount of Cementite-Free Bainite is assessed as insignificant. The relatively high coiling temperature of 550° C. will favour Ferritic Bainite (FB) over Upper Bainite (UB) and since this elevated coiling temperature provides sufficient kinetics for carbide precipitation with—foremost—Ti, but also Nb, and/or Mo, the amount of carbon partitioning during phase transformation is limited as much of the carbon is consumed in the carbide precipitation process with aforementioned elements. This will lead to Ferritic Bainite that is reinforced with TiC or Ti-based composite carbide precipitates (including for instance apart from Ti also Nb and/or Mo) with only little or no martensite plus retained austenite or cementite for that matter.

Steel sheet 16J is a comparative example as the hole expansion ratio λ is below 50%. The microstructure of this steel sheet has a slightly lower amount of Ferritic Bainite (FB) than the inventive examples in Table 2.3 and consequently a slightly higher fraction of Upper Bainite (UB). However, the fractions of both bainitic morphologies come close to that of the inventive examples in this Table. The amount of martensite plus retained austenite of comparative example 16J is in the same range as that of the inventive examples and well below 2% like many of the inventive examples in Table 2.3. The amount of carbon that can stay in solid solution in the steel matrix is quite low and assumed to be less than 0.02 wt %. Excess carbon will either lead to the formation of (1) cementite, (2) martensite and/or retained austenite, and/or (3) form carbide precipitates with elements like Ti, Nb, V, and/or Mo. Process conditions and alloy composition will control to what extent these microstructural elements are being formed. Since the amount of carbon of comparative example 16J is much higher than that of all the inventive examples (Table 2.1) and the sum of the amount of carbide forming elements Ti, Nb, V, and/or Mo is much lower, the atomic ratio A of comparative example is well above 2.2 with a value of 3.45. Because of this much higher atomic ratio A and the observation that the amount of martensite plus retained austenite of comparative example 16J is similar to that of the inventive examples, leads to the conclusion that the microstructure of comparative example 16J must contain substantially more cementite than all the other inventive examples. This is confirmed by visual inspection of the microstructures of all examples shown in Table 2.3 after etching with a 4% Picral solution to selectively outline cementite. Though an accurate quantification of the amount of cementite is practically impossible, the fraction cementite for comparative example 16J is estimated to be above 5%, whereas that of the inventive examples is estimated to be well below 5%.

Microstructures of Examples 17G to 20J Coiled at 500° C. (Table 2.4):

The properties of all the inventive examples, except for inventive example 19I, are derived from microstructures that consist of a mixture of Ferritic Bainite (FB), Granular Bainite (GB), and Upper Bainite (UB). Inventive example 19I has a microstructure that also consists of a mixture of Ferritic Bainite (FB) and Upper Bainite (UB), but that has no significant amount of Granular Bainite (GB) as the amount of martensite plus retained austenite is well below 1%. The amount of Ferritic Bainite (FB) is typically in the range of 40 to 60%, whereas the amount of Upper Bainite is typically in the range of 35 to 60%. This minor presence of Upper Bainite is associated with the presence of some cementite based on visual inspection with light-optical microscopy after etching with a 4% Picral solution to selectively outline cementite. The amount of martensite plus retained austenite (M+RA) is in all cases below 5%, and in most cases below 3%. The lowest amount of martensite plus retained austenite (M+RA) measured for the inventive examples is 0.4%.

Since the amount of martensite plus retained austenite is so low, the amount of Granular Bainite (GB) in most of the inventive examples in Table 2.4 is assessed as relatively small (≤25%) and since the coiling temperature used is still relatively high, the amount of Cementite-Free Bainite is assessed as insignificant. The relatively high coiling temperature of 500° C. is likely to favour Ferritic Bainite (FB) over Upper Bainite (UB) and since this elevated coiling temperature provides sufficient kinetics for at least partial carbide precipitation with—foremost—Ti, but also Nb, and/or Mo, the amount of carbon partitioning during phase transformation is limited as much of the carbon is consumed in the carbide precipitation process with aforementioned elements. This will lead to Ferritic Bainite that is partially reinforced with TiC or Ti-based composite carbide precipitates (including for instance apart from Ti also Nb and/or Mo) with subsequently only little or hardly any martensite plus retained austenite or cementite for that matter.

Steel sheet 20J is a comparative example as the hole expansion ratio λ is below 50%. The microstructure of this steel sheet has a similar amount of Ferritic Bainite (FB) and Upper Bainite (UB) as the inventive examples in Table 2.4. The amount of martensite plus retained austenite of comparative example 20J is in the same range as that of the inventive examples and well below 3% like many of the inventive examples in Table 2.4. The amount of carbon that can stay in solid solution in the steel matrix is quite low and assumed to be less than 0.02 wt %. Excess carbon will either lead to the formation of (1) cementite, (2) martensite and/or retained austenite, and/or (3) form carbide precipitates with elements like Ti, Nb, V, and/or Mo. Process conditions and alloy composition will control to what extent these microstructural elements are being formed. Since the amount of carbon of comparative example 20J is much higher than that of all the inventive examples (Table 2.1) and the sum of the amount of carbide forming elements Ti, Nb, V, and/or Mo is much lower, the atomic ratio A of comparative example is well above 2.2 with a value of 3.45. Because of this much higher atomic ratio A and the observation that the amount of martensite plus retained austenite of comparative example 20J is similar to that of the inventive examples, leads to the conclusion that the microstructure of comparative example 20J must contain substantially more cementite than all the other inventive examples. This is confirmed by visual inspection of the microstructures of all examples shown in Table 2.4 after etching with a 4% Picral solution to selectively outline cementite. Though an accurate quantification of the amount of cementite is practically impossible, the fraction cementite for comparative example 20J is estimated to be above 5%, whereas that of the inventive examples is estimated to be well below 5%.

To achieve a steel with a yield strength of at least 570 and at most 900 MPa, a tensile strength of at least 760 and at most 960 MPa, an A50 tensile elongation of at least 10%, and a hole expansion ratio λ of at least 50%, the microstructure of the steel should comprise:

- at least 90% Bainite, or preferably at least 95% Bainite, or more preferably at least 97% Bainite, or still more preferably at least 98% Bainite, or most preferably at least 99% Bainite, wherein the Bainite consists of:

- a mixture of Upper Bainite (UB), Ferritic Bainite (FB), and optionally Granular Bainite (GB), which are reinforced with Ti-based composite carbide precipitates, or preferably a mixture of predominantly Ferritic Bainite (FB) and a minor fraction of Upper Bainite (UB) and Granular Bainite (GB), which are reinforced with Ti-based composite carbide precipitates, and in which the overall microstructure of the steel consists preferably of:

at most 40% lath-like bainitic ferrite (BF, type 2), including more than 0% and at most 5% cementite, preferably 0.01-4% cementite, more preferably 0.02-3% cementite, even more preferably 0.02-2% cementite, most preferably 0.02-1% cementite, at least 60% irregular-shaped bainitic ferrite (BF, type 1), and at most 5% martensite plus retained austenite (M+RA), and preferably at most 3% martensite plus retained austenite, more preferably at most 2% martensite plus retained austenite, even more preferably at most 1% martensite plus retained austenite, most preferably no presence of martensite plus retained austenite.

TABLE 2.1

Compositions of steels.

| Alloy | C wt % | Si wt % | Mn wt % | Al wt % | P wt % | S ppm | Ti wt % | Nb wt % | V wt % | Mo wt % | Cr wt % | B ppm | N ppm | Cr + 2 Mo wt % | Mn + Cr + 2 Mo wt % | Ti_sol wt % | Atomic ratio* C/[Ti_sol + Nb + V + Mo] | Example |
|---|---|---|---|---|---|---|---|---|---|---|---|---|---|---|---|---|---|---|
| A | 0.031 | 0.509 | 1.863 | 0.053 | 0.012 | 4 | 0.157 | 0.001 | 0.005 | 0.005 | 0.002 | 20 | 53 | 0.012 | 1.875 | 0.139 | 0.845 | Inventive |
| B | 0.032 | 0.477 | 1.826 | 0.048 | 0.013 | 7 | 0.159 | 0.001 | 0.006 | 0.004 | 0.514 | 19 | 61 | 0.522 | 2.348 | 0.138 | 0.876 | Inventive |
| C | 0.032 | 0.503 | 1.850 | 0.059 | 0.013 | 6 | 0.158 | 0.001 | 0.005 | 0.005 | 0.002 | 1 | 52 | 0.012 | 1.862 | 0.140 | 0.866 | Inventive |
| D | 0.031 | 0.497 | 1.377 | 0.048 | 0.012 | 7 | 0.159 | 0.001 | 0.005 | 0.005 | 0.523 | 18 | 51 | 0.533 | 1.910 | 0.142 | 0.828 | Inventive |
| E | 0.032 | 0.217 | 1.836 | 0.046 | 0.012 | 3 | 0.152 | 0.001 | 0.005 | 0.003 | 0.533 | 17 | 57 | 0.539 | 2.375 | 0.132 | 0.923 | Inventive |
| F | 0.032 | 0.211 | 1.363 | 0.041 | 0.012 | 10 | 0.109 | 0.001 | 0.005 | 0.097 | 0.522 | 18 | 59 | 0.716 | 2.079 | 0.089 | 0.897 | Inventive |
| G | 0.041 | 0.488 | 1.356 | 0.050 | 0.011 | 14 | 0.152 | 0.001 | 0.008 | 0.004 | 0.507 | 19 | 46 | 0.515 | 1.871 | 0.136 | 1.123 | Inventive |
| H | 0.039 | 0.213 | 1.354 | 0.047 | 0.011 | 19 | 0.125 | 0.000 | 0.005 | 0.003 | 0.499 | 18 | 49 | 0.505 | 1.859 | 0.108 | 1.366 | Inventive |
| I | 0.038 | 0.209 | 1.369 | 0.046 | 0.011 | 19 | 0.106 | 0.039 | 0.004 | 0.004 | 0.500 | 20 | 55 | 0.508 | 1.877 | 0.087 | 1.346 | Inventive |
| **J** | 0.093 | 0.178 | 1.232 | 0.031 | 0.011 | 15 | 0.118 | 0.001 | 0.005 | 0.003 | 0.909 | 1 | 49 | 0.915 | 2.147 | 0.101 | **3.453** | Comparative |

Atomic ratio C/[Ti_sol + Nb + V + Mo] with elements expressed in weight % is defined as:

$$\frac{C/12}{(\mathrm{Ti_sol}/48 + Nb/93 + V/51 + Mo/96)}$$

with the amount of free Ti not bound to N expressed as $$Ti_{_sol} = Ti - \left(\frac{48}{14}\right) \times N$$

with Ti and N in weight %

TABLE 2.2

Process settings, microstructures, and steel properties with coiling at 450° C.

| | | PROCESS SETTINGS | | | | | MICROSTRUCTURE | | | | | |
|---|---|---|---|---|---|---|---|---|---|---|---|---|
| | | | | | | | BF (%) | | M + RA | $Fe_3C$ | | |
| Steel | Alloy | RHT (° C.) | $T_{in}$ (° C.) | FRT (° C.) | $T_{SAC}$ (° C.) | CT (° C.) | Type1 | Type2 | (%) | (–) | FB | GB |
| | | | | | | | building blocks | | | | composites | |
| 1 | A | 1240 | 965 | 870 | 465 | 450 | 27.0 | 73.0 | 0.0 | yes– | □ | — |
| 2 | B | 1240 | 960 | 870 | 485 | 450 | 30.0 | 70.0 | 0.0 | yes– | □ | — |
| 3 | C | 1240 | 965 | 860 | 480 | 450 | 63.0 | 36.8 | 0.2 | yes– | ■ | — |
| 4 | D | 1240 | 990 | 890 | 510 | 450 | 39.0 | 60.8 | 0.2 | yes– | □ | — |
| 5 | E | 1240 | 975 | 875 | 490 | 450 | 32.0 | 67.8 | 0.2 | yes– | □ | — |
| 6 | F | 1240 | 985 | 880 | 500 | 450 | 39.0 | 61.0 | 0.0 | yes– | □ | — |

| | MICROSTRUCTURE | | MECHANICAL PROPERTIES | | | | | | | |
|---|---|---|---|---|---|---|---|---|---|---|
| Steel | UB | CFB | t (mm) | Rp (MPa) | Rm (MPa) | YR (a.u.) | Ag (%) | A50 (%) | λ (%) | Example |
| | composites | | | | | | | | | |
| 1 | ■ | — | 3.35 | 794 | 858 | 0.93 | 4.4 | 10.1 | 109 | Inventive |
| 2 | ■ | — | 3.54 | 838 | 909 | 0.92 | 4.2 | 10.1 | 99 | Inventive |
| 3 | □ | — | 3.38 | 664 | **731** | 0.91 | 5.8 | 12.4 | 98 | Comparative |
| 4 | ■ | — | 3.73 | 737 | 829 | 0.89 | 5.4 | 12.3 | 112 | Inventive |

TABLE 2.2-continued

| Process settings, microstructures, and steel properties with coiling at 450° C. | | | | | | | | | | |
|---|---|---|---|---|---|---|---|---|---|---|
| 5 | ■ | — | 3.47 | 805 | 887 | 0.91 | 3.4 | 10.7 | 106 | Inventive |
| 6 | ■ | — | 3.36 | 712 | 786 | 0.91 | 4.4 | 10.5 | 96 | Inventive |

RHT = Reheating Temperature
$T_{in}$ = Entry Temperature last rolling pass
FRT = Finish Rolling Temperature
$T_{SAC}$ = Stop Accelerated Cooling Temperature
CT = Coiling Temperature
yes− = Estimated to be more than 0% and at most 5%
yes+ = Estimated to be more than 5%
BF, Type1 = Bainitic Ferrite with a Kernel Average Misorientation of 0 to 1 degrees
BF, Type2 = Bainitic Ferrite with a Kernel Average Misorientation of 1 to 5 degrees
M + RA = Martensite + Retained Austenite
$Fe_3C$ = Cementite
FB = Ferritic Bainite
GB = Granular Bainite
UB = Upper Bainite
CFB = Cementite-Free Bainite
— No significant presence
○ Vol. fraction estimated ≤25%
□ Vol. fraction estimated 25-60%
■ Vol. fraction estimated ≥60%

TABLE 2.3

Process settings, microstructures, and steel properties with coiling at 550° C.

| | | PROCESS SETTINGS | | | | | MICROSTRUCTURE | | | | | |
|---|---|---|---|---|---|---|---|---|---|---|---|---|
| | | | | | | | BF (%) | | MR + A | $Fe_3C$ | | |
| Steel | Alloy | RHT (° C.) | $T_{in}$ (° C.) | FRT (° C.) | $T_{SAC}$ (° C.) | CT (° C.) | Type1 | Type2 | (%) | (−) | FB | GB |
| | | | | | | | building blocks | | | | composites | |
| 7 | A | 1240 | 990 | 890 | 545 | 550 | 64.0 | 34.1 | 1.9 | yes− | ■ | ○ |
| 8 | B | 1240 | 980 | 880 | 555 | 550 | 68.0 | 28.2 | 3.8 | yes− | ■ | ○ |
| 9 | C | 1240 | 985 | 880 | 580 | 550 | 60.0 | 39.5 | 0.5 | yes− | ■ | ○ |
| 10 | D | 1240 | 975 | 875 | 550 | 550 | 60.0 | 38.7 | 1.3 | yes− | ■ | ○ |
| 11 | E | 1240 | 970 | 870 | 540 | 550 | 61.0 | 36.5 | 2.5 | yes− | ■ | ○ |
| 12 | F | 1240 | 980 | 880 | 550 | 550 | 61.0 | 36.3 | 2.7 | yes− | ■ | ○ |
| 13 | G | 1240 | 985 | 900 | 550 | 550 | 71.0 | 27.2 | 1.8 | yes− | ■ | ○ |
| 14 | H | 1240 | 975 | 895 | 555 | 550 | 67.0 | 29.1 | 3.9 | yes− | ■ | ○ |
| 15 | I | 1240 | 985 | 905 | 550 | 550 | 66.0 | 30.3 | 3.7 | yes− | ■ | ○ |
| 16 | **J** | 1240 | 980 | 890 | 555 | 550 | 52.0 | 46.9 | 1.1 | **yes+** | □ | ○ |

| | MICROSTRUCTURE | | MECHANICAL PROPERTIES | | | | | | | |
|---|---|---|---|---|---|---|---|---|---|---|
| Steel | UB | CFB | t (mm) | Rp (MPa) | Rm (MPa) | YR (a.u.) | Ag (%) | A50 (%) | λ (%) | Example |
| | composites | | | | | | | | | |
| 7 | □ | — | 3.62 | 702 | 829 | 0.85 | 7.4 | 15.8 | 82 | Inventive |
| 8 | □ | — | 3.48 | 697 | 836 | 0.83 | 6.8 | 14.4 | 98 | Inventive |
| 9 | □ | — | 3.71 | 713 | 800 | 0.89 | 8.2 | 17.4 | 101 | Inventive |
| 10 | □ | — | 3.70 | 743 | 840 | 0.88 | 6.7 | 14.7 | 89 | Inventive |
| 11 | □ | — | 3.26 | 700 | 868 | 0.81 | 6.7 | 13.8 | 81 | Inventive |
| 12 | □ | — | 3.54 | 600 | 754 | 0.80 | 7.0 | 14.6 | 87 | Inventive |
| 13 | □ | — | 3.51 | 718 | 839 | 0.86 | 7.9 | 17.1 | 85 | Inventive |
| 14 | □ | — | 3.43 | 625 | 772 | 0.81 | 8.3 | 17.5 | 83 | Inventive |

TABLE 2.3-continued

| Process settings, microstructures, and steel properties with coiling at 550° C. | | | | | | | | | | |
|---|---|---|---|---|---|---|---|---|---|---|
| 15 | □ | — | 3.49 | 626 | 780 | 0.80 | 7.7 | 15.8 | 81 | Inventive |
| 16 | □ | — | 3.38 | 736 | 856 | 0.86 | 8.1 | 14.2 | **46** | Comparative |

RHT = Reheating Temperature
$T_{in}$ = Entry Temperature last rolling pass
FRT = Finish Rolling Temperature
$T_{SAC}$ = Stop Accelerated Cooling Temperature
CT = Coiling Temperature
yes− = Estimated to be more than 0% and at most 5%
yes+ = Estimated to be more than 5%
BF, Type1 = Bainitic Ferrite with a Kernel Average Misorientation of 0 to 1 degrees
BF, Type2 = Bainitic Ferrite with a Kernel Average Misorientation of 1 to 5 degrees
M + RA = Martensite + Retained Austenite
$Fe_3C$ = Cementite
FB = Ferritic Bainite
GB = Granular Bainite
UB = Upper Bainite
CFB = Cementite-Free Bainite
— No significant presence
○ Vol. fraction estimated ≤25%
□ Vol. fraction estimated 25-60%
■ Vol. fraction estimated ≥60%

TABLE 2.4

| Process settings, microstructures, and steel properties with coiling at 500° C. | | | | | | | | | | | | |
|---|---|---|---|---|---|---|---|---|---|---|---|---|
| | | | | | | | MICROSTRUCTURE | | | | | |
| | | PROCESS SETTINGS | | | | | BF (%) | | M + RA | $Fe_3C$ | | |
| Steel | Alloy | RHT (° C.) | $T_{in}$ (° C.) | FRT (° C.) | $T_{SAC}$ (° C.) | CT (° C.) | Type1 | Type2 building | (%) blocks | (–) | FB composites | GB |
| 17 | G | 1240 | 985 | 890 | 515 | 500 | 59.0 | 36.8 | 4.2 | yes− | □ | ○ |
| 18 | H | 1240 | 980 | 890 | 520 | 500 | 44.0 | 53.6 | 2.4 | yes− | □ | ○ |
| 19 | I | 1240 | 975 | 900 | 500 | 500 | 40.0 | 59.6 | 0.4 | yes− | □ | — |
| 20 | **J** | 1240 | 965 | 890 | 550 | 500 | 54.0 | 44.6 | 1.4 | **yes+** | □ | ○ |

| | MICROSTRUCTURE | | MECHANICAL PROPERTIES | | | | | | | |
|---|---|---|---|---|---|---|---|---|---|---|
| Steel | UB composites | CFB | t (mm) | Rp (MPa) | Rm (MPa) | YR (a.u.) | Ag (%) | A50 (%) | λ (%) | Example |
| 17 | □ | — | 3.53 | 650 | 829 | 0.78 | 5.6 | 11.2 | 74 | Inventive |
| 18 | □ | — | 3.59 | 681 | 781 | 0.87 | 5.2 | 11.4 | 91 | Inventive |
| 19 | □ | — | 3.47 | 735 | 799 | 0.92 | 6.2 | 12.2 | 88 | Inventive |
| 20 | □ | — | 3.66 | 643 | 779 | 0.83 | 6.0 | 12.9 | **48** | Comparative |

RHT = Reheating Temperature
$T_{in}$ = Entry Temperature last rolling pass
FRT = Finish Rolling Temperature
$T_{SAC}$ = Stop Accelerated Cooling Temperature
CT = Coiling Temperature
yes− = Estimated to be more than 0% and at most 5%
yes+ = Estimated to be more than 5%
BF, Type1 = Bainitic Ferrite with a Kernel Average Misorientation of 0 to 1 degrees
BF, Type2 = Bainitic Ferrite with a Kernel Average Misorientation of 1 to 5 degrees
M + RA = Martensite + Retained Austenite
$Fe_3C$ = Cementite
FB = Ferritic Bainite
GB = Granular Bainite
UB = Upper Bainite
CFB = Cementite-Free Bainite
— No significant presence
○ Vol. fraction estimated ≤25%
□ Vol. fraction estimated 25-60%
■ Vol. fraction estimated ≥60%

The invention claimed is:

1. A hot rolled high strength steel strip consisting of:
0.02-0.13 wt. % C;
1.20-2.20 wt. % Mn;
0.10-1.00 wt. % Si;
0.01-0.10 wt. % Al;
0.09-0.18 wt. % Ti;
0.001-0.010 wt. % N;
0.005-0.2 wt. % Mo;
0-0.10 wt. % P;
0-0.01 wt. % S;
0-1.5 wt. % Cu;
0-1.0 wt. % Cr;
0-0.50 wt. % Ni;
0-0.30 wt. % V;
0-0.04 wt. % Nb;
wherein Ti+Nb≤0.25 wt. %,
wherein Cr+Mo≤1.0 wt. %,
remainder iron and inevitable impurities,
the steel having a microstructure consisting of (in volume %):
at least 85% bainite,
at most 10% martensite plus retained austenite,
more than 0.01% and at most 5% cementite,
inevitable amounts of inclusions,
the sum adding up to 100 volume %;
wherein the bainite consists of at least one member of the group consisting of Ferritic Bainite (FB), Granular Bainite (GB), Upper Bainite (UB), and Cementite-Free Bainite (CFB), and
wherein the cementite is related to the presence of the Upper Bainite; and
wherein the steel strip microstructure contains at least 60% lath-like bainitic ferrite and at most 40% irregular-shaped bainitic ferrite;
wherein the steel strip has the following mechanical properties:
a tensile strength of at least 760 and at most 960 MPa,
a total elongation (A50) of at least 10%,
a hole expansion ratio (λ) value of at least 50%, or
wherein the steel strip has the following mechanical properties:
a tensile strength of at least 960 and at most 1380 MPa,
a total elongation (A50) of at least 9%,
a hole expansion ratio (λ) value of at least 40%;
wherein the equation $$\frac{C/12}{(Ti_sol/48+Nb/93+V/51+Mo/96)}$$

has a lower limit of 0.45 and an upper limit of 2.2,
wherein Ti_sol is defined as $$Ti_{_sol} = Ti - \left(\frac{48}{14}\right) \times N.$$

2. The high strength steel strip according to claim 1, wherein the equation has a lower limit of 0.55 and an upper limit of 2.1;
wherein the bainite consists of a mixture of Upper Bainite (UB), Ferritic Bainite (FB), and optionally Granular Bainite (GB), which is reinforced with Ti-based composite carbide precipitate and optionally reinforced with Nb, V, and/or Mo-carbide precipitate.

3. The high strength steel strip according to claim 1, wherein the steel strip has limited ranges for one or more of the following elements:
0.02-0.12 wt. % C;
1.20-2.20 wt. % Mn;
0.10-0.95 wt. % Si;
0.09-0.18 wt. % Ti;
0.0010-0.005 wt. % B
0.005-0.2 wt. % Mo;
0-0.6 wt. % Cu;
0-0.9 wt. % Cr;
0-0.3 wt. % Ni;
0-0.20 wt. % V;
0-0.04 wt. % Nb.

4. The high strength steel strip according to claim 1, wherein the steel strip has limited ranges for one or more of the following elements:
0.02-0.06 wt. % C;
1.30-2.20 wt. % Mn;
0.10-0.60 wt. % Si;
0.09-0.18 wt. % Ti;
0.0010-0.004 wt. % B;
0.005-0.2 wt. % Mo;
0-0.5 wt. % Cu;
0-0.8 wt. % Cr;
0-2 wt. % Ni;
0-0.18 wt. % V;
0-0.04 wt. % Nb,
wherein 1.6 wt. %≤Mn+Cr+2Mo≤2.4 wt. %,
the steel strip having a microstructure consisting of (in volume %):
at least 90% bainite,
at most 5% martensite plus retained austenite,
0.01-4% cementite,
inevitable amounts of inclusions,
the sum adding up to 100 volume %.

5. The high strength steel strip according to claim 4, wherein the steel has a microstructure with at most 4% martensite plus retained austenite.

6. The high strength steel strip according to claim 4, wherein the steel strip has the following mechanical properties:
a yield strength of at least 570 and at most 900 MPa,
a tensile strength of at least 760 and at most 960 MPa,
a total elongation (A50) of at least 10%,
a hole expansion ratio (λ) value of at least 50%.

7. The high strength steel strip according to claim 4, wherein the steel strip has:
0.02-0.06 wt. % C;
1.30-2.20 wt. % Mn;
0.10-0.60 wt. % Si;
0.09-0.18 wt. % Ti;
0.0010-0.004 wt. % B;
0.005-0.2 wt. % Mo;
0-0.5 wt. % Cu;
0-0.8 wt. % Cr;
0-0.2 wt. % Ni;
0-0.18 wt. % V;
0-0.04 wt. % Nb,
wherein 1.6 wt. %≤Mn+Cr+2Mo≤2.4 wt. %,
the steel strip having a microstructure consisting of (in volume %):
at least 90% bainite,
at most 5% martensite plus retained austenite,
0.01-4% cementite,
inevitable amounts of inclusions,
the sum adding up to 100 volume %.

8. The high strength steel strip according to claim 4, wherein the steel strip has:
0.02-0.05 wt. % C;
1.30-2.00 wt. % Mn;
0.10-0.60 wt. % Si;
0.11-0.18 wt. % Ti;
0.0010-0.003 wt. % B;
0.005-0.1 wt. % Mo;
optionally one or more of:
0-0.1 wt. % Cu;
0-0.6 wt. % Cr;
0-0.1 wt. % Ni;
0-0.1 wt. % V;
0.01-0.04 wt % Nb,
wherein 1.6 wt. %≤Mn+Cr+2Mo≤2.4 wt. %,
the steel having a microstructure consisting of (in volume %):
at least 90% bainite,
at most 5% martensite plus retained austenite,
0.02-3% cementite,
inevitable amounts of inclusions,
the sum adding up to 100 volume %.

9. The high strength steel strip according to claim 1, wherein the steel strip has limited ranges for the following elements:
0.03-0.12 wt. % C;
1.50-2.20 wt. % Mn;
0.20-0.95 wt. % Si;
0.10-0.18 wt. % Ti;
0.0010-0.004 wt. % B;
0.005-0.2 wt. % Mo;
0-0.5 wt. % Cu;
0-0.9 wt. % Cr;
0-0.2 wt. % Ni;
0-0.18 wt. % V;
0-0.04 wt. % Nb,
wherein Mn+Cr+2Mo≥2.3 wt. %,
the steel strip having a microstructure consisting of (in volume %):
at least 90% bainite,
at most 5% martensite plus retained austenite,
0.01-4% cementite,
inevitable amounts of inclusions,
the sum adding up to 100 volume %.

10. The high strength steel strip according to claim 9, wherein the steel has a microstructure with at most 4% martensite plus retained austenite.

11. The high strength steel strip according to claim 9, wherein:
Cr+2Mo≥0.20 wt. %.

12. The high strength steel strip according to claim 9, wherein the steel strip has the following mechanical properties:
a yield strength of at least 670 and at most 990 MPa,
a tensile strength of at least 960 and at most 1380 MPa,
a total elongation (A50) of at least 9%,
a hole expansion ratio (λ) value of at least 40%;
wherein the bainite consists of a mixture of predominantly Ferritic Bainite (FB) and a minor fraction of Upper Bainite (UB) and Granular Bainite (GB), which is reinforced with Ti-based composite carbide precipitate and optionally reinforced with Nb, V, and/or Mo-carbide precipitate.

13. The high strength steel strip according to claim 1, wherein the steel has:
0.03-0.12 wt. % C;
1.50-2.20 wt. % Mn;
0.20-0.95 wt. % Si;
0.10-0.18 wt. % Ti;
0.0010-0.004 wt. % B;
0.005-0.2 wt. % Mo;
0-0.5 wt. % Cu;
0-0.9 wt. % Cr;
0-0.2 wt. % Ni;
0-0.18 wt. % V;
0-0.04 wt. % Nb,
wherein Mn+Cr+2Mo≥2.3 wt. %,
the steel having a microstructure consisting of (in volume %):
least 90% bainite,
at most 5% martensite plus retained austenite,
0.01-4% cementite,
inevitable amounts of inclusions,
the sum adding up to 100 volume %.

14. The high strength steel strip according to claim 13, wherein the steel strip has:
0 0.04-0.09 wt. % C;
1.60-2.00 wt. % Mn;
0.40-0.70 wt. % Si;
0.12-0.18 wt. % Ti;
0.0010-0.003 wt. % B;
0.01-0.2 wt. % Mo;
0-0.1 wt. % Cu;
0-0.5 wt. % Cr;
0-0.1 wt. % Ni;
0-0.1 wt. % V;
0.01-0.04 wt. % Nb,
wherein Mn+Cr+2Mo≥2.3 wt. %,
the steel strip having a microstructure consisting of (in volume %):
least 90% bainite,
an absence of martensite plus retained austenite,
0.01-4% cementite,
inevitable amounts of inclusions,
the sum adding up to 100 volume %.

15. The high strength steel strip according to claim 1, wherein the steel strip has limited ranges for one or more of the following elements:
0.02-0.12 wt. % C;
1.20-2.20 wt. % Mn;
0.10-0.95 wt. % Si;
0.09-0.18 wt. % Ti;
0.0010-0.005 wt. % B
0.005-0.2 wt. % Mo.

16. The high strength steel strip according to claim 1, wherein the steel strip contains limited ranges for one or more of the following elements:
0-0.6 wt. % Cu;
0-0.9 wt. % Cr;
0-0.3 wt. % Ni;
0-0.20 wt. % V;
0-0.04 wt. % Nb.

17. The high strength steel strip according to claim 1, wherein the Nb is present at 0.01-0.04 wt. %.

18. A hot rolled high strength steel strip consisting of:
0.03-0.12 wt. % C;
1.50-2.20 wt. % Mn;
0.20-0.95 wt. % Si;
0.01-0.10 wt. % Al;
0.10-0.18 wt. % Ti;
0.001-0.010 wt. % N;
0.005-0.2 wt. % Mo;
0-0.10 wt. % P;
0-0.01 wt. % S;

0.0010-0.005 wt. % B;
0-0.5 wt. % Cu;
0-0.9 wt. % Cr;
0-0.2 wt. % Ni;
0-0.18 wt. % V;
0-0.04 wt. % Nb;
wherein Ti+Nb≤0.25 wt. %,
wherein Cr+Mo≤1.0 wt. %,
wherein Mn+Cr+2 Mo≥2.3wt. %,
remainder iron and inevitable impurities,
the steel strip having a microstructure consisting of (in volume %):
at least 90% bainite,
at most 5% martensite plus retained austenite,
more than 0.01% and at most 5% cementite,
inevitable amounts of inclusions,
the sum adding up to 100 volume %;
wherein the steel strip contains at least 60% lath-like bainitic ferrite and at most 40% irregular-shaped bainitic ferrite.

19. A method of manufacturing a high strength steel strip according to claim 1, comprising the steps of:
casting a slab, followed by the step of reheating the solidified slab to a temperature between 1050 and 1260° C. and hot rolling said slab, or casting a slab or strip followed directly by the step of hot rolling said slab or strip and
hot rolling the steel slab or strip with an entry temperature for the final rolling stand between 960 and 1100° C. and
finishing said hot rolling at a finish rolling temperature between 850 and 1080° C., and
cooling the hot rolled steel strip with a cooling rate between 10 to 250° C./s, to a temperature on the run-out-table between 600 and 440° C., followed by
coiling between 420 and 580° C.

20. A method of manufacturing a high strength steel strip according to claim 1, comprising the steps of:
casting a slab, followed by the step of reheating the solidified slab to a temperature between 1050 and 1260° C. and hot rolling said slab, or casting a slab or strip followed directly by the step of hot rolling said slab or strip and
hot rolling the steel slab or strip with an entry temperature for the final rolling stand between 960 and 1100° C. and
finishing said hot rolling at a finish rolling temperature between 850 and 1080° C., and
cooling the hot rolled steel strip with a cooling rate between 10 to 250° C./s, to a temperature on the run-out-table between 550 and 420° C., followed by
coiling between 370 and 580° C.

21. A car or truck component, having been produced from the steel strip according to claim 1.

* * * * *